US011804326B2

(12) United States Patent
Taniguchi et al.

(10) Patent No.: US 11,804,326 B2
(45) **Date of Patent: *Oct. 31, 2023**

(54) COIL COMPONENT, METHOD OF MAKING THE SAME, AND POWER SUPPLY CIRCUIT UNIT

(71) Applicant: TDK Corporation, Tokyo (JP)

(72) Inventors: Masamichi Taniguchi, Tokyo (JP); Makoto Endo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 71 days.

This patent is subject to a terminal disclaimer.

(21) Appl. No.: 17/237,291

(22) Filed: Apr. 22, 2021

(65) Prior Publication Data

US 2021/0241962 A1 Aug. 5, 2021

Related U.S. Application Data

(62) Division of application No. 15/363,737, filed on Nov. 29, 2016, now Pat. No. 11,031,173.

(30) Foreign Application Priority Data

Dec. 2, 2015 (JP) ..... 2015-235650
Dec. 2, 2015 (JP) ..... 2015-235651

(51) Int. Cl.

| | |
|---|---|
| ***H01F 5/00*** | (2006.01) |
| ***H01F 27/28*** | (2006.01) |
| ***H01F 41/10*** | (2006.01) |
| ***H01F 27/255*** | (2006.01) |
| ***H01F 41/04*** | (2006.01) |
| ***H01F 27/29*** | (2006.01) |

(52) U.S. Cl.
CPC ..... *H01F 27/2804* (2013.01); *H01F 27/255* (2013.01); *H01F 27/292* (2013.01); *H01F 41/046* (2013.01); *H01F 41/10* (2013.01); *H01F 2027/2809* (2013.01)

(58) Field of Classification Search
CPC ..... H01F 27/2804
USPC ..... 336/200
See application file for complete search history.

(56) References Cited

U.S. PATENT DOCUMENTS 6,373,368 B1 4/2002 Shikama et al.
9,236,171 B2 1/2016 Ito et al.
(Continued)

FOREIGN PATENT DOCUMENTS

JP 2001-52937 A 2/2001
JP 2009-055412 A 3/2009
(Continued)

*Primary Examiner* — Ronald Hinson
(74) *Attorney, Agent, or Firm* — Oliff PLC

(57) ABSTRACT

A coil component includes an element body having a rectangular main surface; a coil provided within the element body, wherein the coil having a lower coil portion and an upper coil portion; terminal electrodes provided at positions corresponding to corners of the main surface; extracting conductors connected within the element body to both end portions of the coil, wherein the extracting conductors extending from the end portions of the coil to terminal electrodes provided on the main surface; and a dummy electrode provided on the main surface at a position different from those of the terminal electrodes, wherein the dummy electrode is conducted to neither of the extracting conductors.

2 Claims, 20 Drawing Sheets

(56) References Cited

U.S. PATENT DOCUMENTS

| | | | | |
|---|---|---|---|---|
| 9,704,640 | B2 | 7/2017 | Choi et al. | |
| 2003/0206089 | A1 | 11/2003 | Shikama et al. | |
| 2007/0040163 | A1 | 2/2007 | Okuzawa et al. | |
| 2010/0157565 | A1* | 6/2010 | Yoshida | H01G 4/33 361/811 |
| 2012/0133472 | A1 | 5/2012 | Nishikawa et al. | |
| 2013/0222101 | A1* | 8/2013 | Ito | H01F 3/08 336/83 |
| 2014/0009254 | A1* | 1/2014 | Ohkubo | H01F 17/0033 336/192 |
| 2014/0266551 | A1 | 9/2014 | Yokoyama | |
| 2014/0266949 | A1 | 9/2014 | Yokoyama | |
| 2015/0097647 | A1 | 4/2015 | Lee et al. | |
| 2015/0357115 | A1 | 12/2015 | Ohkubo et al. | |
| 2016/0104565 | A1* | 4/2016 | Nishiyama | H01F 17/0013 336/200 |
| 2016/0142032 | A1 | 5/2016 | Chong et al. | |
| 2016/0148740 | A1 | 5/2016 | Yokoyama | |

FOREIGN PATENT DOCUMENTS

| | | | |
|---|---|---|---|
| JP | 2011-091097 | A | 5/2011 |
| JP | 2013-225718 | A | 10/2013 |
| JP | 2014-013815 | A | 1/2014 |
| JP | 2014-207432 | A | 10/2014 |
| JP | 2015-076606 | A | 4/2015 |
| JP | 2015-187260 | A | 10/2015 |
| JP | 2015-201606 | A | 11/2015 |

* cited by examiner

101

COIL COMPONENT, METHOD OF MAKING THE SAME, AND POWER SUPPLY CIRCUIT UNIT

CROSS-REFERENCE TO RELATED APPLICATIONS

This is a Division of application Ser. No. 15/363,737 filed Nov. 29, 2016, which in turn claims the benefit of priority from Japanese Patent Applications No. 2015-235650 and No. 2015-235651, filed on Dec. 2, 2015, the entire contents of which are incorporated herein by reference.

BACKGROUND OF THE INVENTION

Field of the Invention

This disclosure relates to a coil component, a method of making the same, and a power supply circuit unit.

Related Background Art

For example, Patent Literature 1 (Japanese Unexamined Patent Publication No. 2013-225718) discloses a coil component which includes a rectangular parallelepiped element body including a coil inside thereof and a pair of terminal electrodes provided on both end surfaces of the element body, and which is a coil component in the related art.

In the coil component disclosed in the Patent Literature 1, the terminal electrodes are provided not only on both end surfaces of the element body, but also extend around to one and the other main surfaces of the element body. Portions of the terminal electrodes, which cover portions of the main surfaces, block magnetic fluxes of the coil, and cause a decrease in inductance. If the area of each of the terminal electrodes is decreased to prevent a decrease in inductance, it is not possible to ensure greater ease of mounting when mounting the coil component on a mounted component (for example, a circuit substrate or an electronic component), which is a problem.

This disclosure provides a coil component and a power supply circuit unit in which it is possible to prevent a decrease in inductance while ensuring greater ease of mounting.

For example, as a coil component in the related art, Patent Literature 2 (Japanese Unexamined Patent Publication No. 2015-76606) discloses a coil component which includes a coil; a magnetic composite material covering the coil; and a pair of extracting conductors through which both end portions of the coil are led out to a component surface, and in which the magnetic composite material and the extracting conductors are exposed to the component surface.

A flip chip method which is advantageous in reducing a mounting area is known as one method of mounting a coil component. In a case where the coil component disclosed in the Patent Literature 2 is mounted by a flip chip method, terminal electrodes to be connected to the extracting conductors are provided on the component surface. If the terminal electrodes are provided via plating, an event that unnecessary plating is formed on the magnetic composite material exposed to the component surface may occur.

This disclosure provides a method of making a coil component, a coil component, and a power supply circuit unit in which when forming terminal electrodes via plating, it is possible to prevent an event that unnecessary plating is formed.

According to an aspect of this disclosure, there is provided a coil component comprising: an element body having a rectangular mounting surface; a coil provided within the element body, wherein the coil includes at least one coil conductor layer; a first terminal electrode provided on the mounting surface at a position corresponding to one corner of the mounting surface; a second terminal electrode provided on the mounting surface at a position corresponding to another corner of the mounting surface; a first extracting conductor connected within the element body to one end portion of the coil, wherein the first extracting conductor extends from the one end portion of the coil to the first terminal electrode provided on the mounting surface; a second extracting conductor connected within the element body to the other end portion of the coil, wherein the second extracting conductor extends from the other end portion of the coil to the second terminal electrode provided on the mounting surface; and at least one dummy electrode provided on the mounting surface at a position different from those of the first terminal electrode and the second terminal electrode, wherein the dummy electrode is conducted to neither the first extracting conductor nor the second extracting conductor.

In the coil component, each of the first terminal electrode and the second terminal electrode is provided at a position corresponding to one corner. For this reason, an area of the mounting surface of the element body which is covered with the first and second terminal electrodes is smaller than that covered with terminal electrodes provided in such a way as to be spanned between a plurality of corners. Accordingly, the first and second terminal electrodes on the mounting surface are unlikely to block magnetic fluxes of the coil. As a result, it is possible to prevent a decrease in inductance. In addition to the first and second terminal electrodes, the dummy electrode conducted to neither the first extracting conductor nor the second extracting conductor is provided on the mounting surface of the element body. The dummy electrode can be disposed at a positon such that the balance of weight of the coil component is stabilized. For this reason, it is possible to further stabilize the balance of weight of the coil component in comparison with that in a case where only the first and second terminal electrodes are provided. As a result, it is possible to ensure greater ease of mounting when mounting the coil component on a mounted component from a mounting surface side. As described above, in the coil component, it is possible to prevent a decrease in inductance while ensuring greater ease of mounting.

In the coil component according to another aspect of this disclosure, two dummy electrodes may be provided, and the dummy electrodes may be respectively provided at positions, the positions are not provided with the first terminal electrode and the second terminal electrode, and the positions correspond to the remaining two corners of the mounting surfaces. In this case, the electrodes are respectively provided at all the corners of the rectangular mounting surface, and thus, it is possible to further stabilize the balance of weight of the coil component, and to improve the ease of mounting of the coil component.

In the coil component according to the aspect of this disclosure, the coil may include two coil conductor layers, and the coil conductor layers may be arranged in a direction perpendicular to the mounting surface.

In the coil component according to the aspect of this disclosure, the coil may include a plurality of bent portions when viewed from a mounting surface side, and the first terminal electrode, the second terminal electrode, and the at least one dummy electrode may be respectively located at positions corresponding to the plurality of bent portions. Magnetic fluxes collide each other in the bent portions of the coil, and as a result, the efficiency of the generation of magnetic fluxes tends to decrease there. When the coil component is viewed from the mounting surface side, the electrodes are respectively provided at the positions corresponding to the bent portions in which the efficiency of the generation of magnetic fluxes is relatively low. As a result, the electrodes are unlikely to affect blocking of magnetic fluxes, and it is possible to prevent a decrease in inductance.

According to an aspect of this disclosure, there is provided a power supply circuit unit including the aforementioned coil component. In the power supply circuit unit of this disclosure, it is possible to prevent a decrease in inductance while ensuring greater ease of mounting of the coil component.

According to an aspect of this disclosure, there is provided a method of making a coil component comprising the steps of: preparing a magnetic element body including a main surface, the magnetic element body having a coil and a pair of extracting conductors within, the pair of extracting conductors extending from both end portions of the coil to the main surface so as to be exposed to the main surface; forming an insulating layer on the main surface of the magnetic element body; and forming a pair of terminal electrodes electrically connected to the pair of extracting conductors exposed to the main surface on the main surface of the magnetic element body via plating. The insulating layer is formed in at least a portion between the pair of terminal electrodes.

In the method of making the coil component, after the insulating layer is formed in at least a portion of the main surface of the magnetic element body between the pair of terminal electrodes, and the pair of terminal electrodes are formed via plating. Plating is not formed in the portion in which the insulating layer is formed when the pair of terminal electrodes are formed via plating, that is, in at least the portion between the pair of terminal electrodes. Accordingly, it is possible to prevent an event that unnecessary plating is formed when forming the terminal electrodes. As a result, it is possible to prevent an event that plating is formed between the pair of terminal electrodes to connect together the terminal electrodes. It is possible to reduce a possibility that the terminal electrodes may be conducted to each other and a short circuit therebetween may occur due to such plating.

In the method of making the coil component according to the aspect of this disclosure, the insulating layer may extend across the main surface between the pair of terminal electrodes in a direction intersecting an alignment direction in of the pair of terminal electrodes. In this case, the insulating layer extends across the main surface in the direction intersecting the alignment direction of the pair of terminal electrodes, and thus, it is possible to prevent an event that unnecessary plating is formed. In addition, a short circuit route between the pair of terminal electrodes on the main surface is completely blocked by the insulating layer. Accordingly, it is possible to more reliably reduce a possibility that the pair of terminal electrodes may be conducted to each other and a short circuit therebetween may occur by the formation of the terminal electrodes via plating.

In the method of making the coil component according to the aspect of this disclosure, the insulating layer may cover the entire region of the main surface, and include holes at positions corresponding to the extracting conductors, and the terminal electrodes may be electrically connected to the extracting conductors via the holes. In this case, the insulating layer covers portions apart from the through holes required for conduction between the terminal electrodes, and it is possible to further prevent an event that unnecessary plating is formed. Since the pair of terminal electrodes are more reliably insulated from each other by the insulating layer, it is possible to more reliably reduce a possibility that the pair of terminal electrodes may be conducted to each other and a short circuit therebetween may occur by the formation of the terminal electrodes via plating.

In the method of making the coil component according to the aspect of this disclosure, in the step of forming the insulating layer, the insulating layer may be formed by coating the main surface with insulative resin. In this case, the insulating layer may be formed of insulative resin.

According to an aspect of this disclosure, there is provided a coil component comprising: a magnetic element body including a main surface, the magnetic element body including a coil and a pair of extracting conductors within, the pair of extracting conductors extending from both end portions of the coil to the main surface so as to be exposed to the main surface; an insulating layer provided on the main surface of the magnetic element body; and a pair of terminal electrodes provided on the main surface of the magnetic element body, the pair of terminal electrodes being plating electrodes electrically connected to the pair of extracting conductors exposed to the main surface. The insulating layer is formed in at least a portion between the pair of terminal electrodes.

In the coil component, the insulating layer is formed in at least a portion of the main surface of the magnetic element body between the pair of terminal electrodes which are plating electrodes. Accordingly, plating is not formed in the portion in which the insulating layer is formed, that is, in at least the portion between the pair of terminal electrodes. As a result, it is possible to prevent an event that unnecessary plating is formed via plating. It is possible to prevent an event that plating is formed between the pair of terminal electrodes to connect together the terminal electrodes. It is possible to reduce a possibility that the terminal electrodes may be conducted to each other and a short circuit therebetween may occur due to such plating.

According to an aspect of this disclosure, there is provided a power supply circuit unit including the aforementioned coil component. Since the power supply circuit unit includes the coil component in which it is possible to prevent an event that unnecessary plating is formed, it is possible to reduce a possibility that the terminal electrodes may be conducted to each other and a short circuit therebetween may occur due to unnecessary plating, or it is possible to reduce a possibility of the occurrence of a short circuit of the power supply circuit unit in its entirety.

DESCRIPTION OF THE PREFERRED EMBODIMENTS

Hereinafter, embodiment of this disclosure will be described in detail with reference to the accompanying drawings. In the description, the same reference signs are assigned to the same elements or elements having the same functions, and duplicated description will be omitted.

First Embodiment

Figure 1:
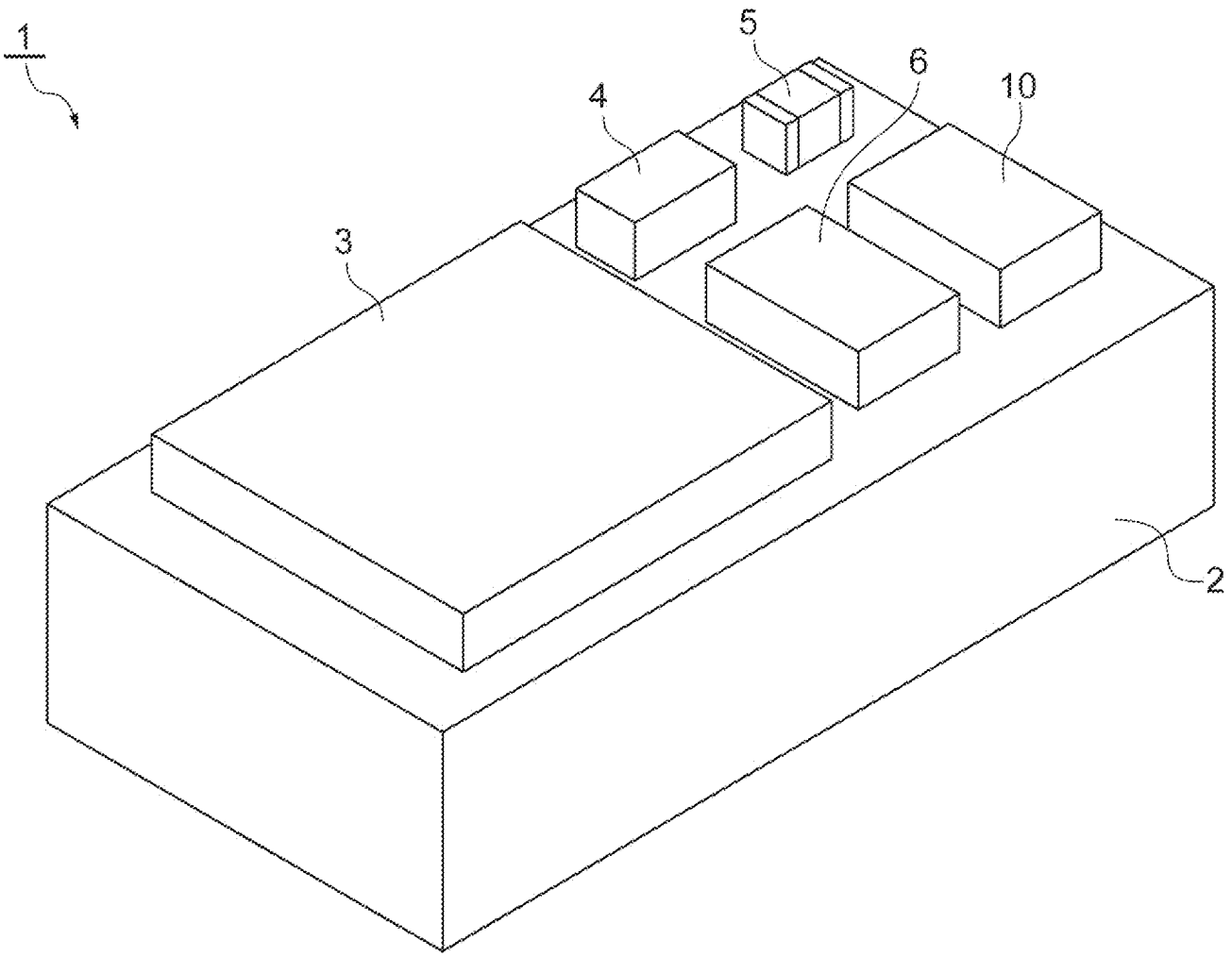
FIG. 1 is a perspective view illustrating a power supply circuit unit of a first embodiment of this disclosure.
Figure 2:
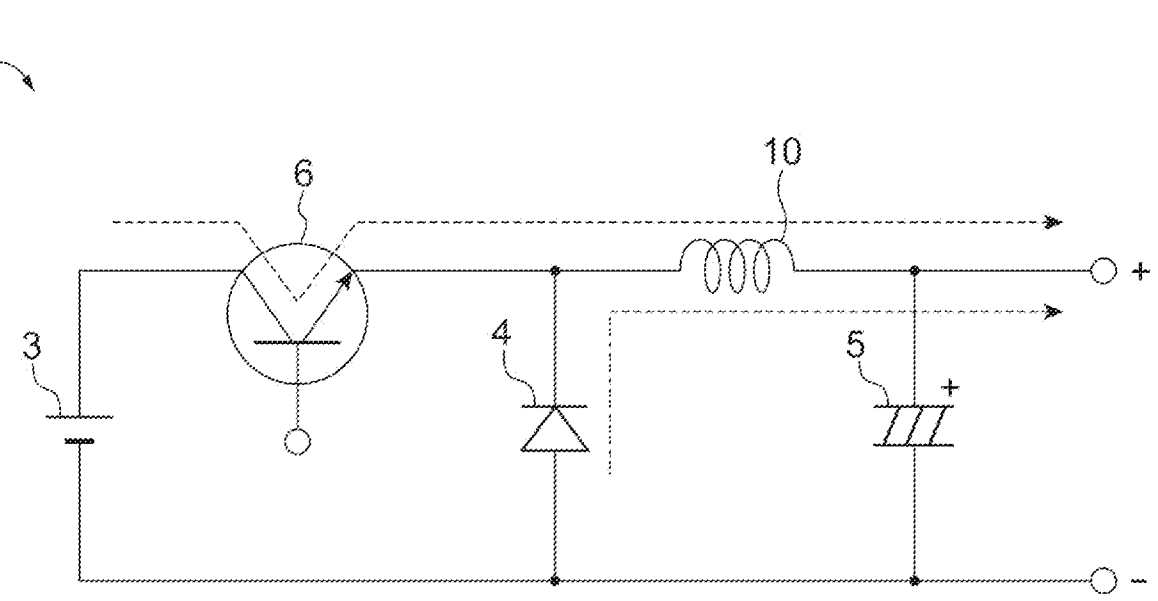
FIG. 2 is a circuit diagram illustrating an equivalent circuit of the power supply circuit unit illustrated in FIG. 1.

First, the entire configuration of a power supply circuit unit 1 of a first embodiment of this disclosure will be described with reference to FIGS. 1 and 2. The power supply circuit unit 1 to be described in the embodiment is a switching power supply circuit unit that converts (steps down) a direct voltage. As illustrated in FIGS. 1 and 2, the power supply circuit unit 1 includes a circuit substrate 2 and electronic components 3, 4, 5, 6 and 10.

Specifically, the power supply circuit unit 1 is configured such that a power supply IC 3, a diode 4, a capacitor 5, a switching element 6, and a coil component 10 are mounted on the circuit substrate 2.

Figure 3:
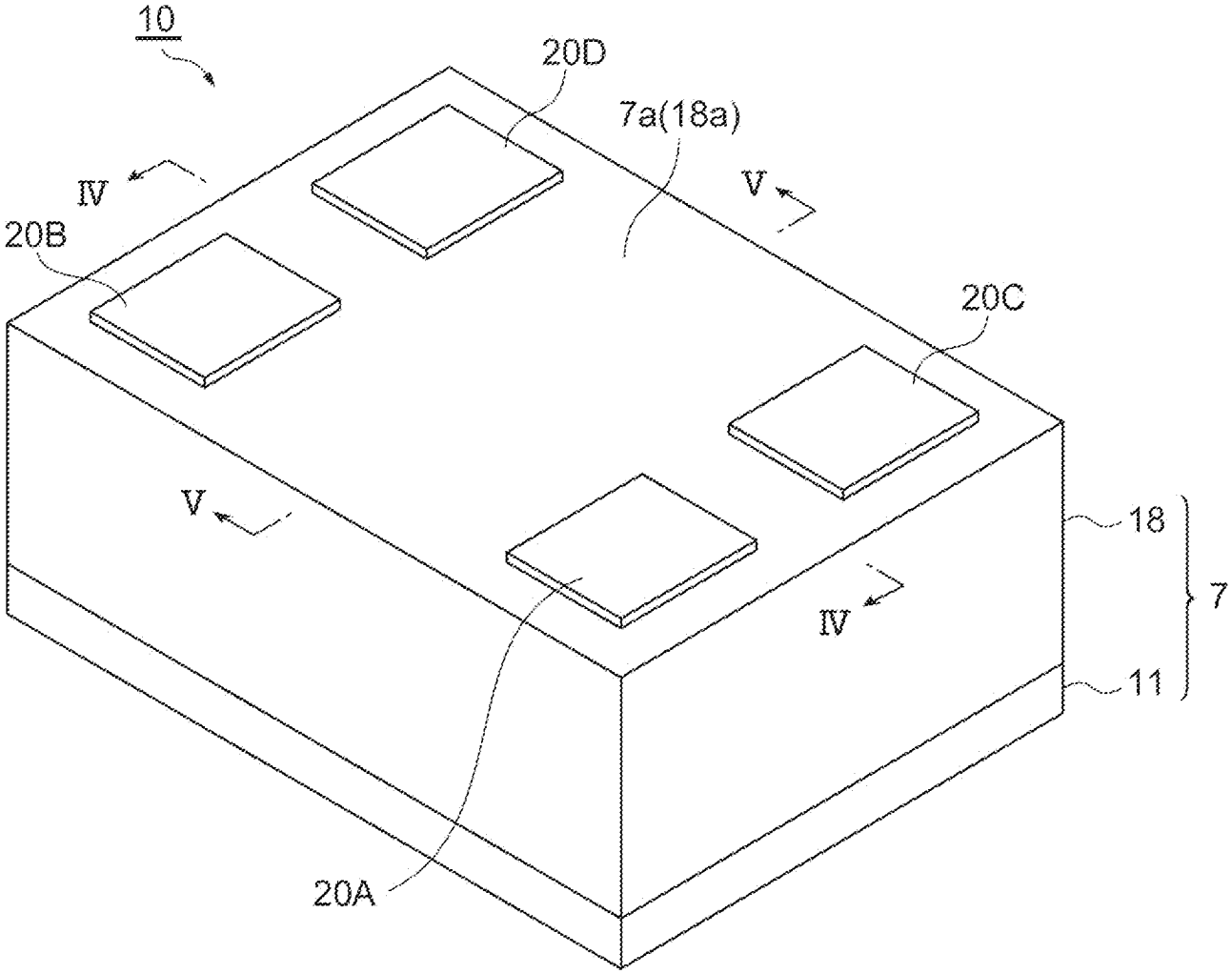
FIG. 3 is a perspective view of a coil component of the first embodiment.
Figure 4:
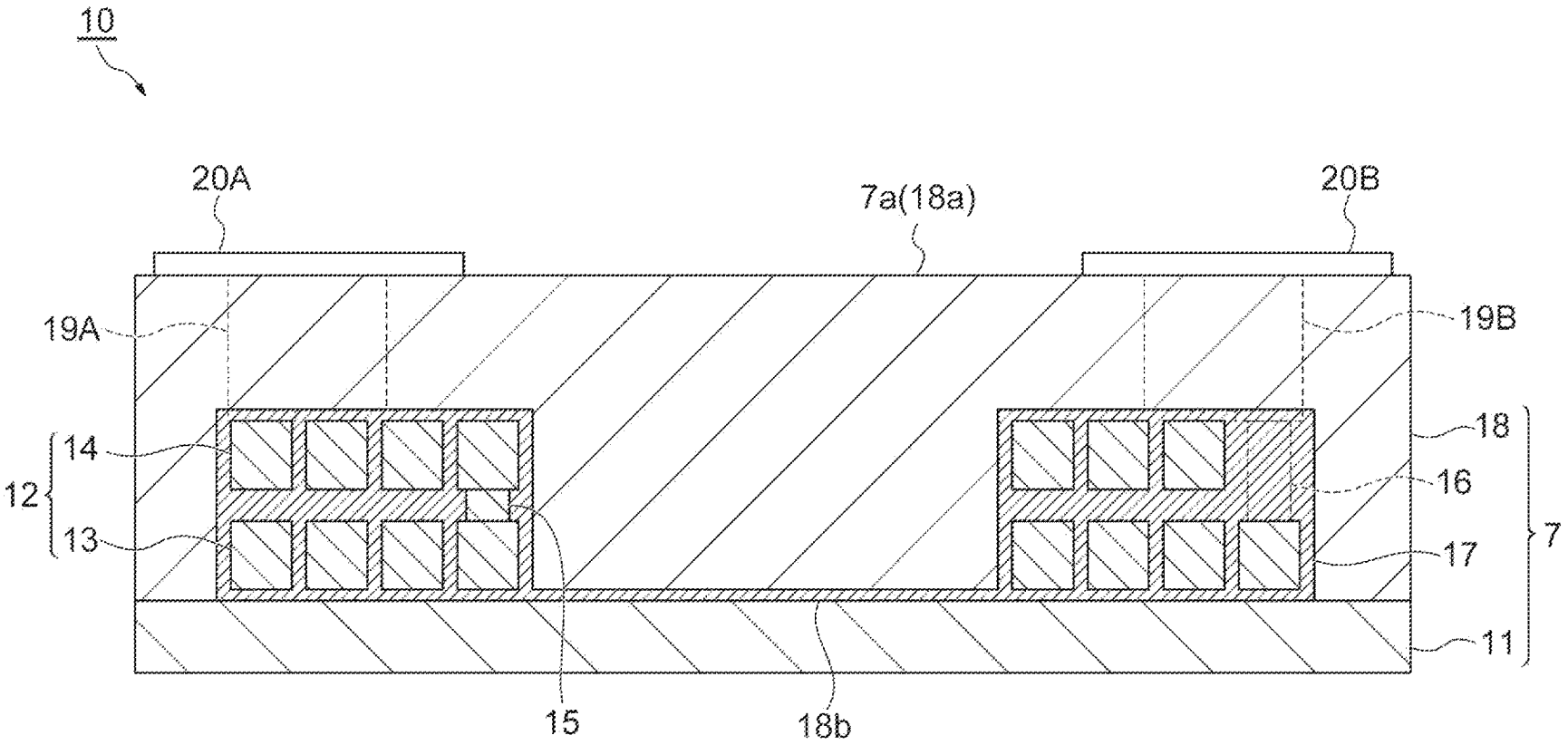
FIG. 4 is a sectional view of the coil component taken along line IV-IV in FIG. 3.
Figure 5:
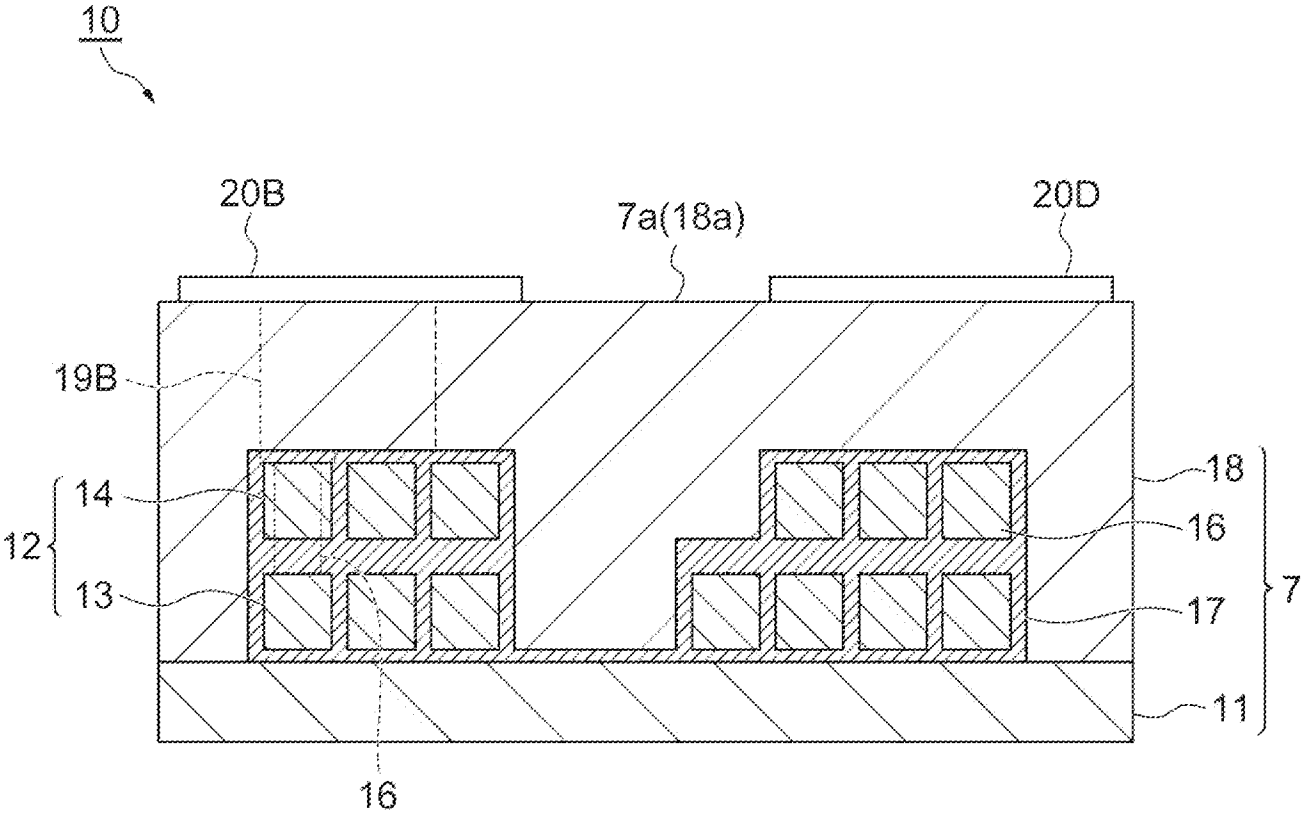
FIG. 5 is a sectional view of the coil component taken along line V-V in FIG. 3.
Figure 6:
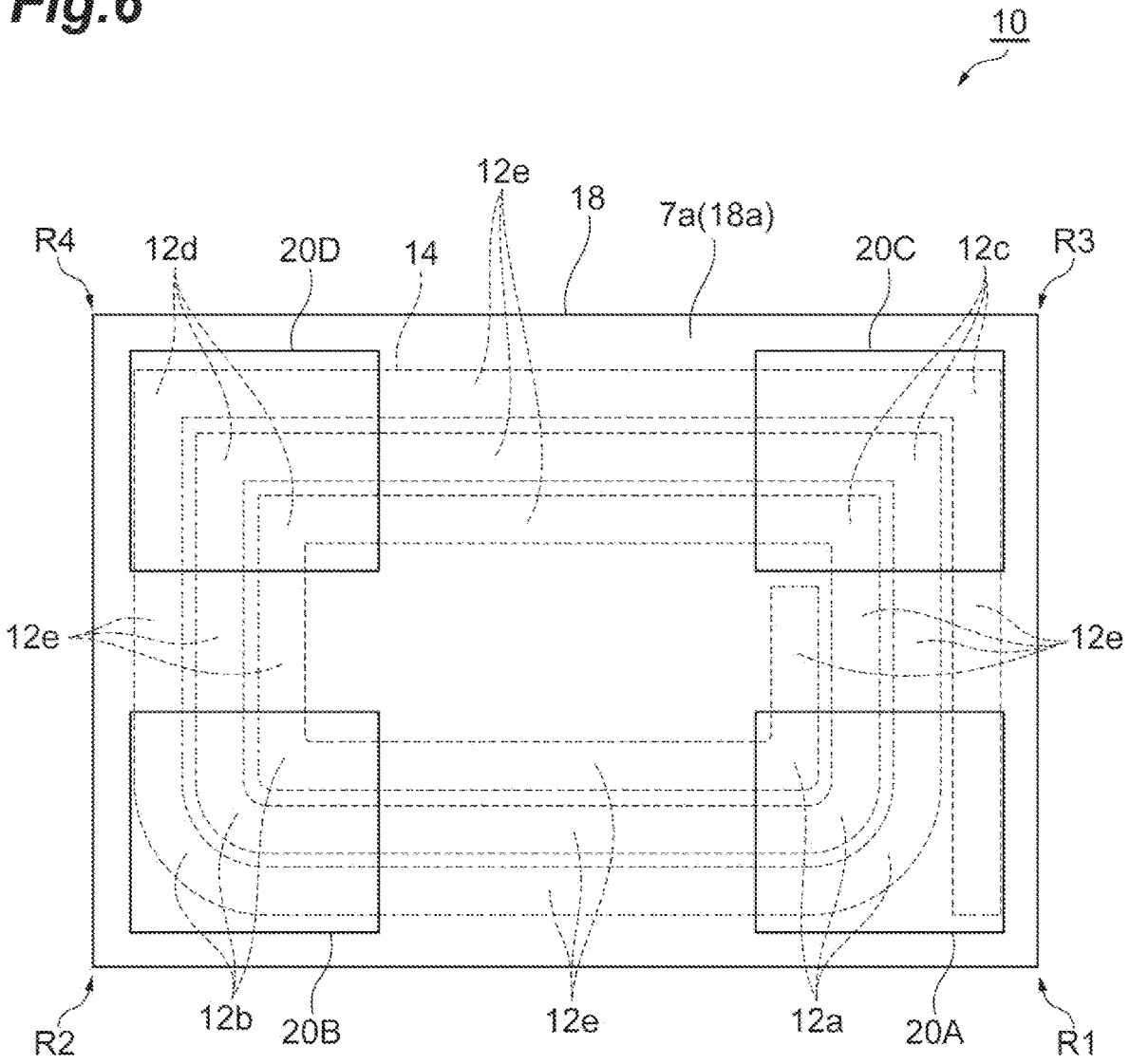
FIG. 6 is a top view of the coil component viewed from a terminal electrode side of the coil component.
Figure 7:
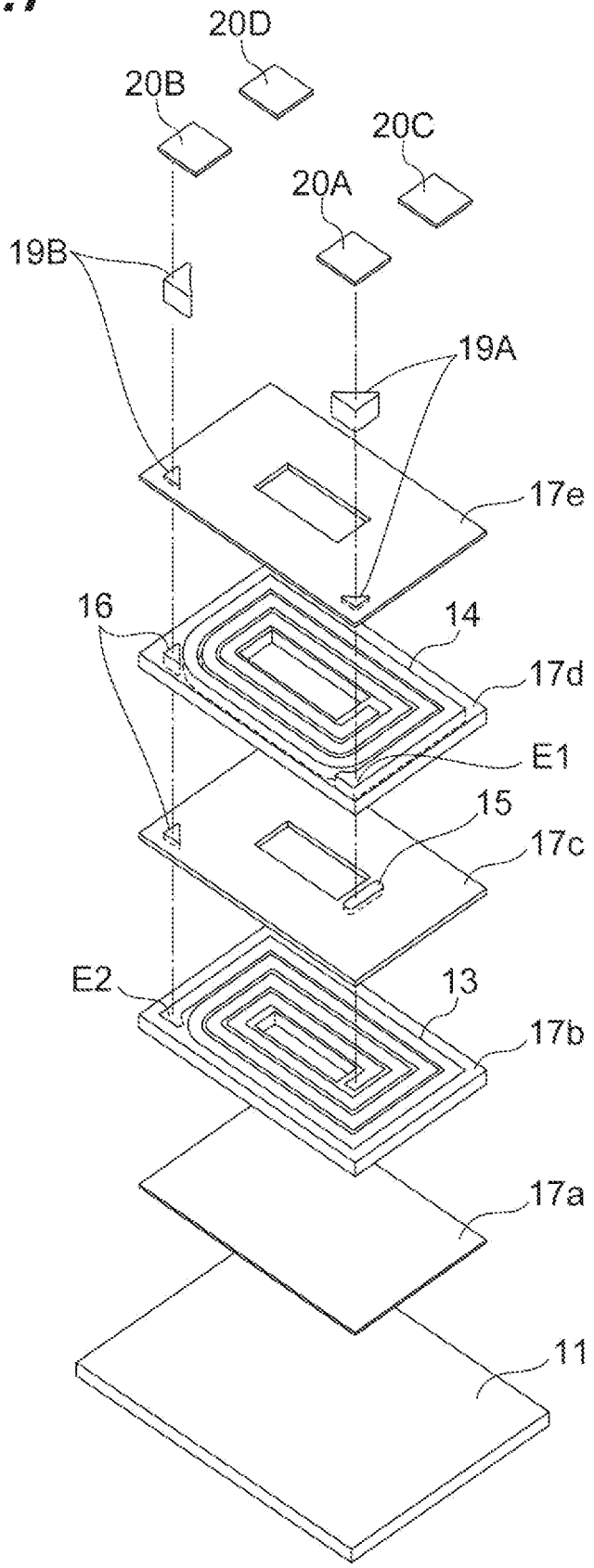
FIG. 7 is an exploded perspective view of the coil component.

The configuration of the coil component 10 of the first embodiment will be described with reference to FIGS. 3 to 7. FIG. 3 is a perspective view of the coil component 10 of the first embodiment. FIG. 4 is a sectional view of the coil component 10 taken along line IV-IV in FIG. 3. FIG. 5 is a sectional view of the coil component 10 taken along line V-V in FIG. 3. FIG. 6 is a top view of the coil component 10 viewed from a terminal electrode 20A and 20B side of the coil component 10. FIG. 7 is an exploded perspective view of the coil component. The exploded perspective view of FIG. 7 does not illustrate a magnetic resin layer 18 illustrated in FIG. 3.

As illustrated in FIG. 3, the coil component 10 includes an element body 7 inside of which the coil 12 (to be described later) is provided. The element body 7 has a rectangular parallelepiped exterior. Examples of the rectangular parallelepiped shape include a rectangular parallelepiped shape having chamfered corners and ridge portions, and a rectangular parallelepiped shape having rounded corners and ridge portions. The element body 7 includes a main surface 7*a*. The main surface 7*a* has a rectangular shape having long sides and short sides. Examples of the rectangular shape include a rectangular shape having rounded corners.

As illustrated in FIG. 6, the main surface 7*a* having a rectangular shape includes four corners R1 to R4. Terminal electrodes 20A and 20B and dummy electrodes 20C and 20D are respectively provided at the corners R1 to R4. The terminal electrode 20A is provided at a position corresponding to one corner R1 of the main surface 7*a*, and the terminal electrode 20B is provided at a position corresponding to another corner R2 of the main surface 7*a*. The dummy electrodes 20C and 20D are provided at positions at which the terminal electrodes 20A and 20B are not provided, and which correspond to the remaining corners R3 and R4 of the main surface 7*a*. That is, the dummy electrode 20C is provided at a position corresponding to the corner R3 of the main surface 7*a*. The dummy electrode 20D is provided at a position corresponding to the corner R4 of the main surface 7*a*. The terminal electrode 20A and the dummy electrode 20C are arranged on one diagonal line (on a diagonal line connecting the corners R1 and R3) of the main surface 7*a*. The terminal electrode 20B and the dummy electrode 20D are arranged on the other diagonal line (on a diagonal line connecting the corners R2 and R4) of the main surface 7*a*. In other words, the terminal electrodes 20A and 20B are adjacent to each other along one long side of the main surface 7*a*. The dummy electrodes 20C and 20D are adjacent to each other along one long side of the main surface 7*a*. The terminal electrodes 20A and 20B and the dummy electrodes 20C and 20D are symmetrical with respect to a bisector of the short sides of the main surface 7*a*.

For example, the element body 7 is formed of a magnetic material. Specifically, the element body 7 includes a magnetic substrate 11 and the magnetic resin layer 18.

The magnetic substrate 11 is a substantially flat substrate formed of a magnetic material such as ferrite (refer to FIG. 7). The magnetic substrate 11 is positioned on a side of the element body 7 which is opposite to the main surface 7*a*.

The magnetic resin layer 18 is formed on the magnetic substrate 11, and includes within the coil 12 (to be described later). The main surface 7*a* of the element body 7 is a surface 18*a* of the magnetic resin layer 18 which is opposite to a surface 18*b* that is a magnetic substrate 11 side surface of the magnetic resin layer 18. The magnetic resin layer 18 is a mixture of magnetic powder and binder resin. The material of the magnetic powder is iron, carbonyl iron, silicon, chromium, nickel, boron, or the like. The material of the binder resin is epoxy resin or the like.

Each of the terminal electrodes 20A and 20B and the dummy electrodes 20C and 20D which are provided on the main surface 7*a* of the element body 7 has the shape of a film, and has a substantially rectangular shape in a top view. The terminal electrodes 20A and 20B and the dummy electrodes 20C and 20D have substantially the same area. The terminal electrodes 20A and 20B and the dummy electrodes 20C and 20D are formed of a conductive material such as Cu. The terminal electrodes 20A and 20B and the dummy electrodes 20C and 20D are plating electrodes which are formed via plating. The terminal electrodes 20A and 20B and the dummy electrodes 20C and 20D may have a single-layer structure or a multi-layer structure.

As illustrated in FIGS. 4 to 7, the coil component 10 includes the coil 12, a covering portion 17, and extracting conductors 19A and 19B inside of the element body 7 (specifically, inside of the magnetic resin layer 18).

The coil 12 is formed a metallic material such as Cu. The axial center of the coil 12 extends along a direction perpendicular to the main surface 7*a*. The coil 12 includes two coil conductor layers. The coil 12 includes a lower coil portion 13 and an upper coil portion 14 as the coil conductor layers, and connection portions 15 and 16. The lower coil portion 13 and the upper coil portion 14 are arranged in the direction (axial direction of the coil 12) perpendicular to the main surface 7*a*. The upper coil portion 14 is positioned closer to a main surface 7*a* side than the lower coil portion 13. The lower coil portion 13 and the upper coil portion 14 have the same winding direction. The connection portion 15 is interposed between the lower coil portion 13 and the upper coil portion 14. An innermost winding portion of the lower coil portion 13 is connected to an innermost winding portion of the upper coil portion 14 via the connection portion 15. The connection portion 16 extends from the lower coil portion 13 toward the main surface 7*a* side. The lower coil portion 13 is connected to the extracting conductor 19B via the connection portion 16.

As illustrated in FIG. 6, the coil 12 is wound into a rectangular shape in a top view. The coil 12 includes a plurality of bent portions (four bent portions in the embodiment) 12*a* to 12*d* which are bent along the corners R1 to R4 of the main surface 7*a*, and a straight portion 12*e* between the bent portions 12*a* to 12*d*. The bent portions 12*a* to 12*d* are not positioned along the sides of the main surface 7*a* having a rectangular shape, and are portions of the coil 12, the directions of which are changed.

The terminal electrodes 20A and 20B and the dummy electrodes 20C and 20D are present at positions corresponding to the bent portions 12*a* to 12*d*. Specifically, the terminal electrode 20A is positioned on the bent portion 12*a* when viewed from a main surface 7*a* side. The terminal electrode 20B is positioned on the bent portion 12*b* when viewed from the main surface 7*a* side. The dummy electrode 20C is positioned on the bent portion 12*c* when viewed from the main surface 7*a* side. The dummy electrode 20D is positioned on the bent portion 12*d* when viewed from the main surface 7*a* side. That is, the terminal electrodes 20A and 20B are spaced away from the dummy electrodes 20C and 20D. As a result, the straight portion 12*e* between the bent portions 12*a* to 12*d* is exposed in a portion of the main surface 7*a* in which the terminal electrodes 20A and 20B and the dummy electrodes 20C and 20D are not formed.

The covering portion 17 has insulative properties, and is formed of insulative resin. Examples of the insulative resin used in the covering portion 17 include polyimide and polyethylene terephthalate. The covering portion 17 integrally covers the lower coil portion 13 and the upper coil portion 14 of the coil 12 inside of the element body 7. The covering portion 17 individually covers the lower coil portion 13, the upper coil portion 14, and the connection portion 15. The covering portion 17 has a layered structure, and includes five insulative resin layers 17*a*, 17*b*, 17*c*, 17*d*, and 17*e* in the embodiment (refer to FIG. 7). The insulative resin layer 17*a* is positioned on a lower side (magnetic substrate 11 side) of the lower coil portion 13. In a top view, the insulative resin layer 17*a* is formed in substantially the same as a region in which the coil 12 is formed. The periphery of and gaps between winding portions of the lower coil portion 13 are filled with the insulative resin layer 17*b* which is the same as the layer of the lower coil portion 13. The insulative resin layer 17*b* has an open region that corresponds to the inner diameter of the coil 12. The insulative resin layer 17*b* extends along a direction perpendicular to the magnetic substrate 11. The insulative resin layer 17*c* is interposed between the lower coil portion 13 and the upper coil portion 14, and has an open region that corresponds to the inner diameter of the coil 12. The periphery of and gaps between winding portions of the upper coil portion 14 are filled with the insulative resin layer 17*d* which is the same as the layer of the upper coil portion 14. The insulative resin layer 17*d* has an open region that corresponds to the inner diameter of the coil 12. The insulative resin layer 17*e* is positioned on an upper side (main surface 7*a* side) of the upper coil portion 14, and has an open region that corresponds to the inner diameter of the coil 12.

The extracting conductors 19A and 19B are formed of Cu. The extracting conductors 19A and 19B respectively extend from end portions E1 and E2 of the coil 12 along the direction perpendicular to the main surface 7*a*. The coil 12 is electrically connected to the terminal electrodes 20A and 20B via the extracting conductors 19A and 19B. The main surface 7*a* is a mounting surface facing mounted components when the mounted components are mounted.

The extracting conductor (first extracting conductor) 19A is connected to one end portion E1 of the coil 12 that is provided in an outermost winding portion of the upper coil portion 14. The extracting conductor 19A extends from the end portion E1 of the coil 12 to the main surface 7*a* of the element body 7 while passing through the magnetic resin layer 18. The extracting conductor 19A is exposed to the main surface 7*a*. The terminal electrode (first terminal electrode) 20A is provided in a region of the main surface 7*a*, in which the extracting conductor 19A is exposed. That is, the extracting conductor 19A extends from the end portion E1 of the coil 12 to the terminal electrode 20A, and is connected to the terminal electrode 20A. Accordingly, the end portion E1 of the coil 12 is electrically connected to the terminal electrode 20A via the extracting conductor 19A.

The extracting conductor (second extracting conductor) 19B is connected to the other end portion E2 of the coil 12 that is provided in an outermost winding portion of the lower coil portion 13. The extracting conductor 19B extends from the end portion E2 of the coil 12 to the main surface 7*a* of the element body 7 while passing through the magnetic resin layer 18. The extracting conductor 19B is exposed to the main surface 7*a*. The terminal electrode (second terminal electrode) 20B is provided in a region of the main surface 7*a*, in which the extracting conductor 19B is exposed. That is, the extracting conductor 19B extends from the end portion E2 of the coil 12 to the terminal electrode 20B, and is connected to the terminal electrode 20B. Accordingly, the end portion E2 of the coil 12 is electrically connected to the terminal electrode 20B via the extracting conductor 19B.

The dummy electrodes 20C and 20D are provided on the main surface 7*a* at positions different from those of the terminal electrodes 20A and 20B. That is, the dummy electrodes 20C and 20D are positioned at locations in which the extracting conductors 19A and 19B are not exposed. The dummy electrodes 20C and 20D are conducted to neither the extracting conductor 19A nor the extracting conductor 19B. That is, the dummy electrodes 20C and 20D are electrically connected to neither the one end portion E1 nor the other end portion E2 of the coil 12.

Hereinafter, a method of making the coil component 10 will be described with reference to FIGS. 8A to 8D, 9A to 9D, and 10A to 10C. FIGS. 8A to 8D, 9A to 9D, and 10A to 10C are views illustrating steps of making the coil component 10.

Figure 8A:
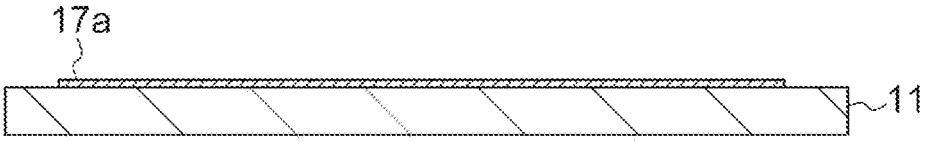
FIGS. 8A to 8D are views illustrating steps of making the coil component.
Figure 8B:
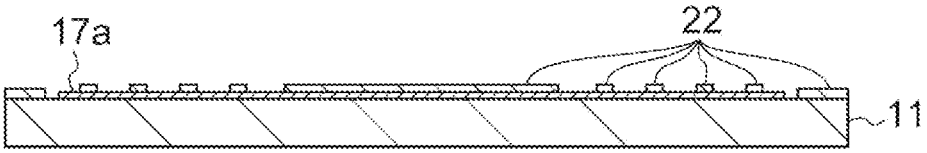
Figure 8C:
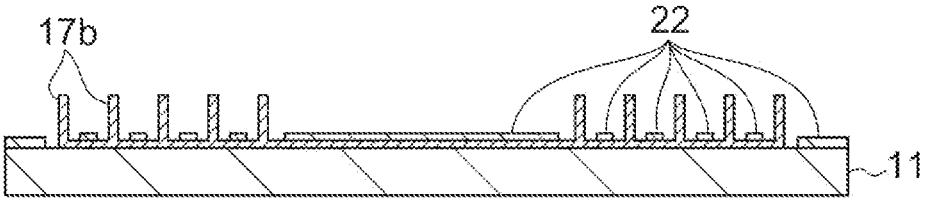
Figure 8D:
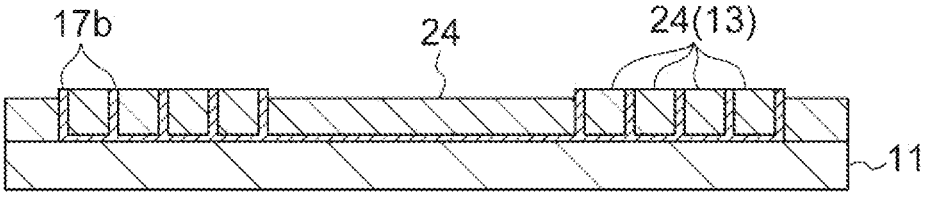

First, as illustrated in FIG. 8A, the insulative resin layer 17*a* of the covering portion 17 is formed by pattern-coating an upper side of the magnetic substrate 11 with an insulative resin paste. Subsequently, as illustrated in FIG. 8B, a seed portion 22 for forming the lower coil portion 13 via plating is formed on the insulative resin layer 17*a*. It is possible to form the seed portion 22 using a predetermined mask via plating or sputtering. Subsequently, as illustrated in FIG. 8C, the insulative resin layer 17*b* of the covering portion 17 is formed. It is possible to obtain the insulative resin layer 17*b* by coating the entire surface of the magnetic substrate 11 with an insulative resin paste, and then removing a portion corresponding to the seed portion 22. That is, the insulative resin layer 17*b* has the function of exposing the seed portion 22. The insulative resin layer 17*b* is a wall-like portion which is erected on the magnetic substrate 11, and divides a region in which the lower coil portion 13 is formed. Subsequently, as illustrated in FIG. 8D, a plating layer 24 is formed in gaps of the insulative resin layer 17*b* using the seed portion 22. At this time, plating develops a layer with which regions divided by the gaps of the insulative resin layer 17*b* is filled, and the developed plating layer serves as the lower coil portion 13. As a result, winding portions of the lower coil portion 13 are positioned in adjacent gaps of the insulative resin layer 17*b*.

Figure 9A:
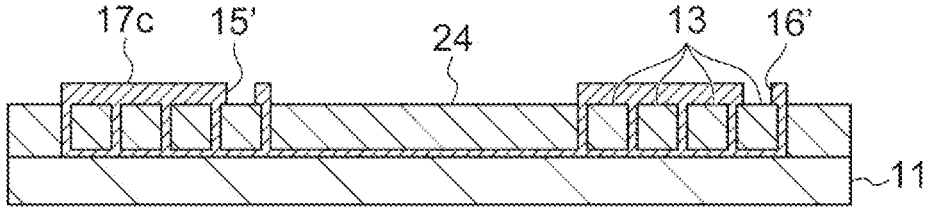
FIGS. 9A to 9D are views illustrating steps of making the coil component.
Figure 9B:
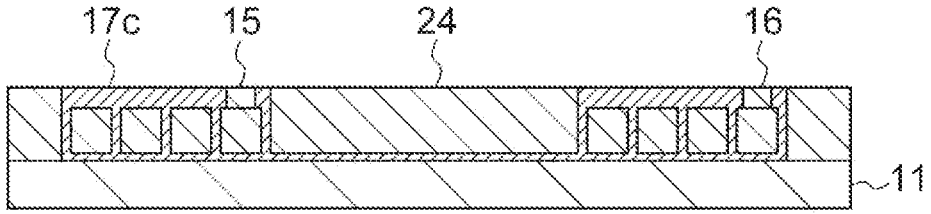

Subsequently, as illustrated in FIG. 9A, the insulative resin layer 17*c* of the covering portion 17 is formed by pattern-coating an upper side of the lower coil portion 13 with an insulative resin paste. At this time, opening portions 15' and 16' for forming the connection portions 15 and 16 are formed in the insulative resin layer 17*c*. Subsequently, as illustrated in FIG. 9B, the connection portions 15 and 16 are respectively formed in the opening portions 15' and 16' of the insulative resin layer 17*c* via plating.

Figure 9C:
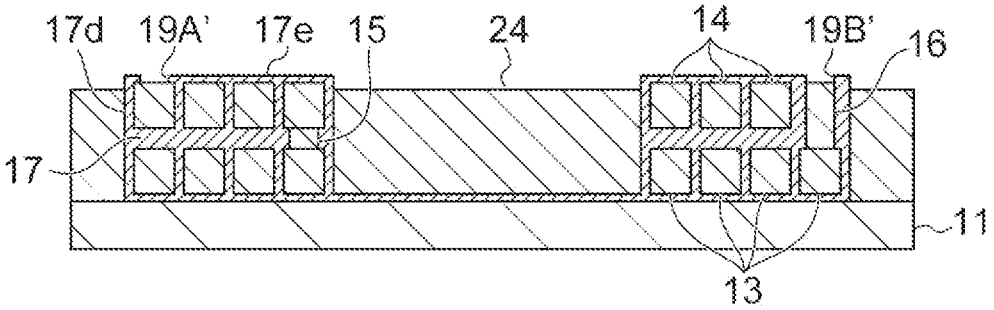

Subsequently, as illustrated in FIG. 9C, the upper coil portion 14 and the insulative resin layers 17*d* and 17*e* of the covering portion 17 are formed on the insulative resin layer 17*c* according to the same as the aforementioned steps. Specifically, according to the same as the sequence illustrated in FIGS. 8B to 8D, a seed portion for forming the upper coil portion 14 via plating is formed. The insulative resin layer 17*d*, which divides a region in which the upper coil portion 14 is formed, is formed. The upper coil portion 14 is formed in gaps of the insulative resin layer 17*d* via plating.

The insulative resin layer 17*e* of the covering portion 17 is formed by pattern-coating the upper side of the upper coil portion 14 with an insulative resin paste. At this time, opening portions 19A' and 19B' for forming the extracting conductor 19A and 19B are formed in the insulative resin layer 17*e*. As described above, the covering portion 17 has a layered structure including a plurality of insulative resin layers 17*a* to 17*e*. The lower coil portion 13 and the upper coil portion 14 are surrounded by the insulative resin layers 17*a* to 17*e*.

Figure 9D:
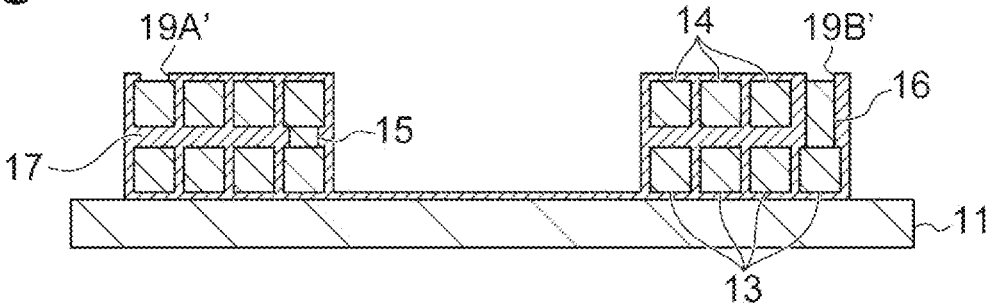
Figure 10A:
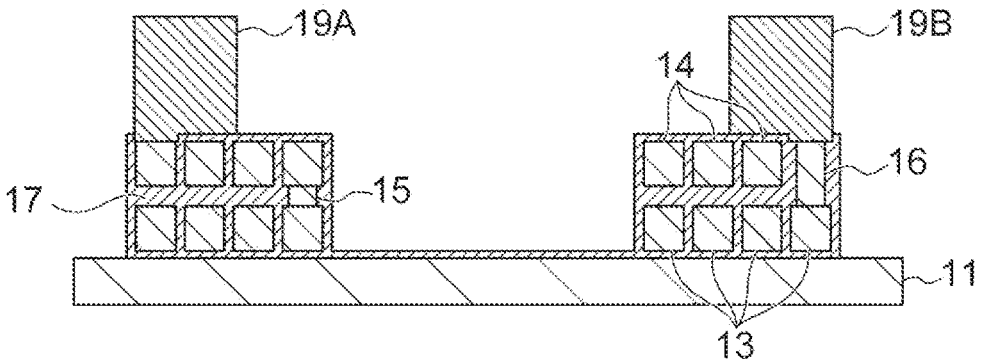
FIGS. 10A to 10C are views illustrating steps of making the coil component.

Subsequently, as illustrated in FIG. 9D, portions (portions that correspond to inner-diameter portions and outer peripheral portions of the lower coil portion 13 and the upper coil portion 14) of the plating layer 24, which do not form the lower coil portion 13 and the upper coil portion 14, are removed via an etching process. In other words, portions of the plating layer 24, which are not covered with the covering portion 17 in FIG. 9C, are removed. Subsequently, as illustrated in FIG. 10A, the extracting conductor 19A is formed at a position corresponding to the opening portion 19A' of the insulative resin layer 17*e*, and the extracting conductor 19B is formed at a position corresponding to the opening portion 19B'. Specifically, seed portions for the extracting conductors 19A and 19B are formed on the opening portions 19A' and 19B' using a predetermined mask via plating or sputtering, and the extracting conductors 19A and 19B are formed using the seed portions via plating.

Figure 10B:
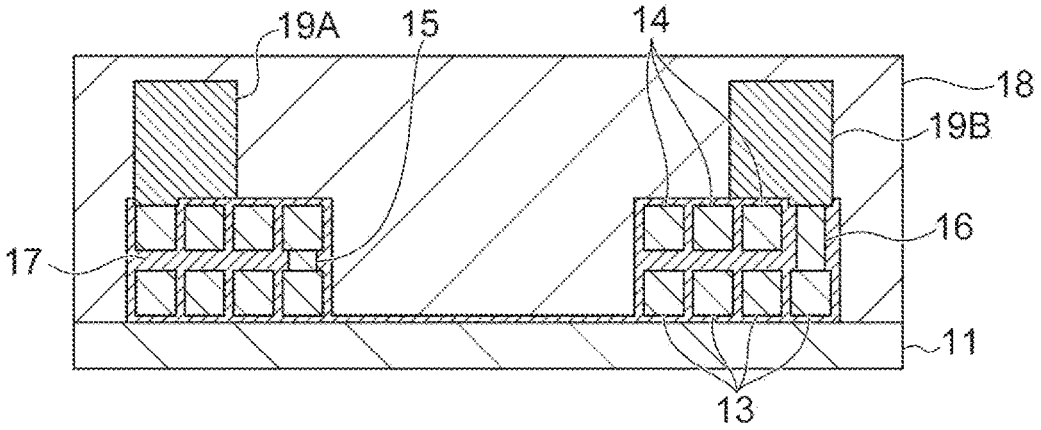
Figure 10C:
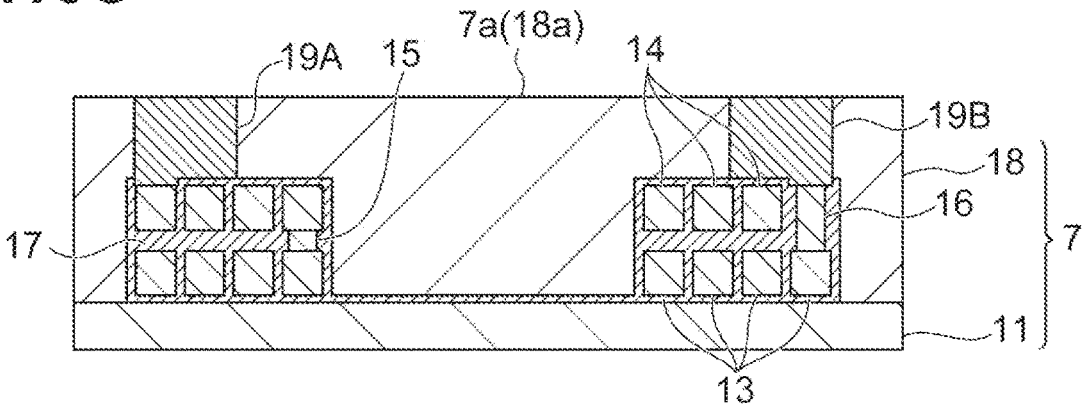

Subsequently, as illustrated in FIG. 10B, the magnetic resin layer 18 is formed by coating the entire surface of the magnetic substrate 11 with magnetic resin and hardening the magnetic resin by a predetermined method. As a result, the peripheries of the covering portion 17 and the extracting conductors 19A and 19B are covered with the magnetic resin layer 18. At this time, an inner-diameter portion of the coil 12 is filled with the magnetic resin layer 18. Subsequently, as illustrated in FIG. 10C, grinding is performed such that the extracting conductors 19A and 19B are exposed from the magnetic resin layer 18.

The element body 7 is formed, and the extracting conductors 19A and 19B are exposed from the main surface 7*a* of the element body 7 by the aforementioned steps. Seed portions are formed in portions of the main surface 7*a*, in which the extracting conductors 19A and 19B are exposed. The terminal electrodes 20A and 20B and the dummy electrodes 20C and 20D are formed using the seed portions via plating. At this time, the terminal electrodes 20A and 20B are formed in the portions of the main surface 7*a*, in which the extracting conductors 19A and 19B are exposed. The dummy electrodes 20C and 20D are formed in portions of the main surface 7*a*, in which the extracting conductors 19A and 19B are not exposed. As a result, the coil component 10 is formed. An insulating overcoat layer may be deposited on the main surface 7*a* such that plating does not develop a layer in portions of the main surface 7*a* in which the aforementioned seed portions are not formed.

Figure 11:
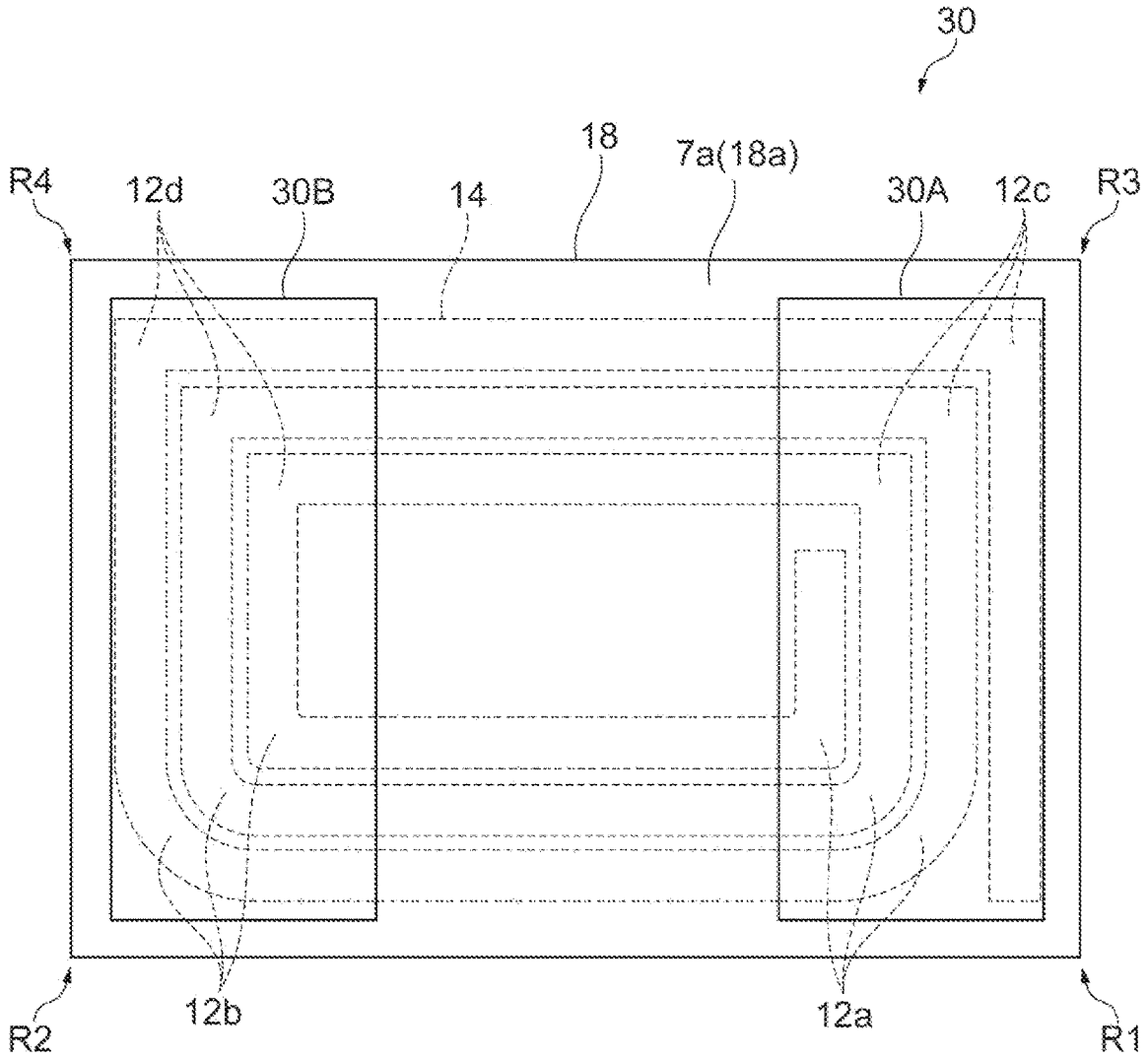
FIG. 11 is a top view of a coil component with two terminals viewed from a terminal electrode side of the coil component with two terminals.
Figure 12:
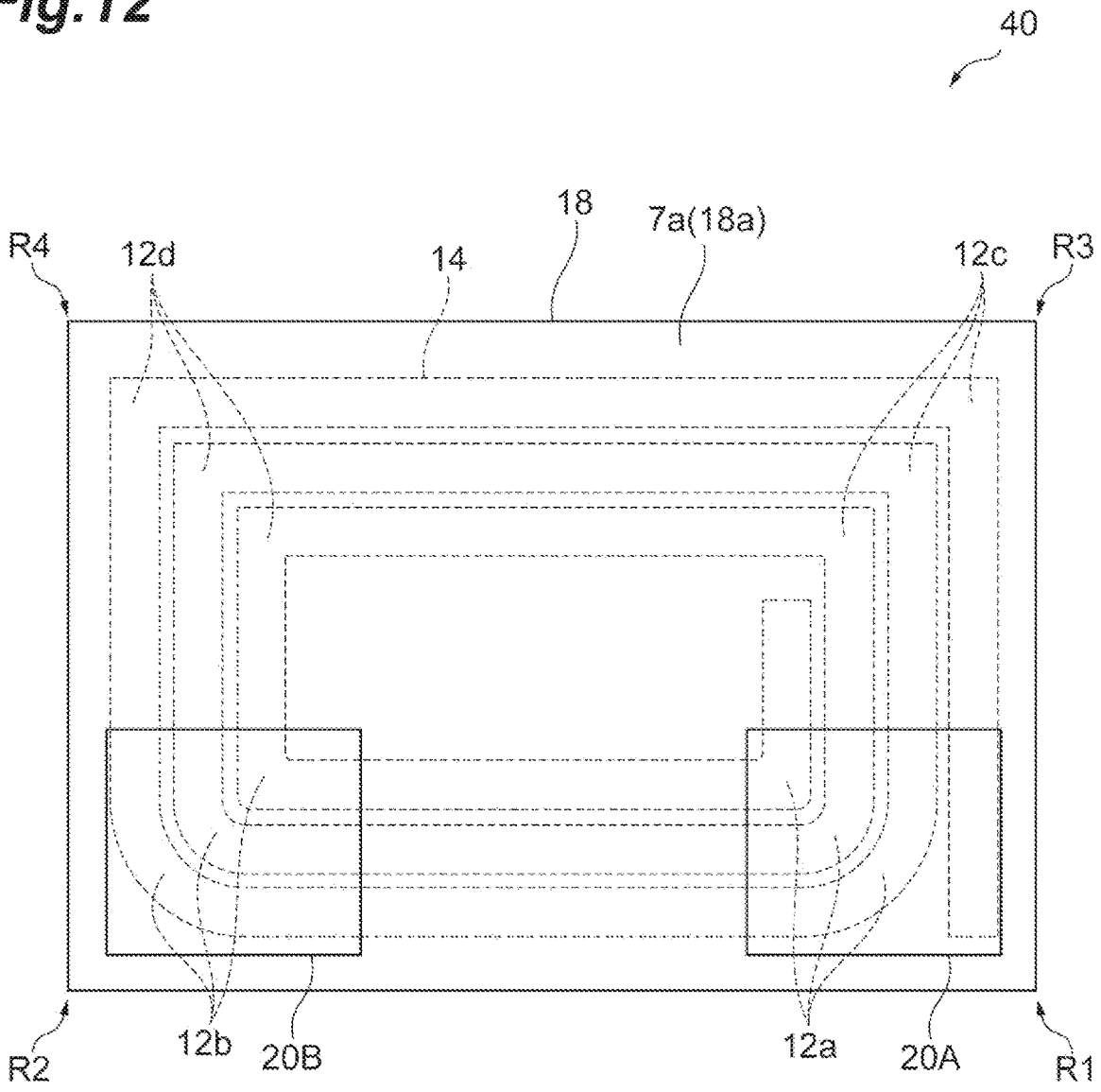
FIG. 12 is a top view of a coil component with two terminals having a form different from that in FIG. 11, viewed from a terminal electrode side of the coil component with two terminals.

Hereinafter, an operation and effects of the coil component 10 of the embodiment will be described with reference to FIGS. 6, 11, and 12. FIG. 11 is a top view of a coil component 30 with two terminals viewed from a terminal electrode 30A and 30B side of the coil component 30. The coil component 30 illustrated in FIG. 11 has disposition of electrodes on the main surface 7*a*, which is different from that of the coil component 10 of the embodiment. The rest of the configuration of the coil component 30 is the same as that of the coil component 10. That is, as illustrated in FIG. 11, the coil component 30 includes two terminal electrodes 30A and 30B instead of four electrodes of the coil component 10, that is, the terminal electrodes 20A and 20B and dummy electrodes 20C and 20D.

The terminal electrode 30A is integrally provided such that the terminal electrode 30A is not only positioned at the corners R1 and R3 of the main surface 7*a* of the element body 7, but also is spanned between the corners R1 and R3. Similar to the terminal electrode 30A, the terminal electrode 30B is integrally provided such that the terminal electrode 30B is not only positioned at the corners R2 and R4 of the main surface 7*a* of the element body 7, but also is spanned between the corners R2 and R4. The area of each of the terminal electrodes 30A and 30B is larger than that of each of the terminal electrodes 20A and 20B and the dummy electrodes 20C and 20D. The sum of the areas of the terminal electrodes 30A and 30B is greater than the sum of those of the terminal electrodes 20A and 20B and the dummy electrodes 20C and 20D.

The inventors have obtained knowledge that since the total area (hereinafter, also referred to as a "terminal area") of the electrodes covering the main surface 7*a* of the element body 7 in the coil component 30 is large, a decrease in inductance is large. The inventors have come to a conclusion that first, the terminal area is to be decreased so as to prevent a decrease in inductance. FIG. 12 is a top view of a coil component 40 with two terminals having a terminal area smaller than that of the coil component 30, which is viewed from a terminal electrode 20A and 20B side of the coil component 40. The coil component 40 is different from the coil component 10 in that the coil component 40 does not include the dummy electrodes 20C and 20D. The rest of the configuration of the coil component 40 is the same as that of the coil component 10. That is, as illustrated in FIG. 12, the coil component 40 includes only two terminal electrodes 20A and 20B among the four electrodes of the coil component 10, that is, the terminal electrodes 20A and 20B and the dummy electrodes 20C and 20D.

The areas of the terminal electrodes 20A and 20B of the coil component 40 are smaller than those of the terminal electrodes 30A and 30B of the coil component 30. The terminal area of the coil component 40 is smaller than that of the coil component 30. As a result of further study, the inventors have obtained knowledge that if merely the terminal area of the coil component 40 is decreased compared to the coil component 30, it is possible to prevent a decrease in inductance, but it is difficult to ensure greater ease of mounting when the coil component 40 is mounted on a mounted component. As a result of not only study on preventing a decrease in inductance, but also in-depth study on the ease of mounting of a coil component, the inventors have come to design the coil component 10 of the embodiment.

In the coil component 10 of the embodiment, the terminal electrodes 20A and 20B are respectively provided at positons corresponding to the corners R1 and R2, that is, each of the terminal electrodes 20A and 20B is provided at a position corresponding to one corner. For this reason, an area of the main surface 7*a* of the element body 7 which is covered with the terminal electrodes 20A and 20B is smaller than that covered with terminal electrodes (for example, the terminal electrodes 30A and 30B illustrated in FIG. 11) which are provided in such a way as to be spanned between corners R1 to R4. Accordingly, the terminal electrodes 20A and 20B on the main surface 7*a* are unlikely to block magnetic fluxes of the coil 12. As a result, it is possible to prevent a decrease in inductance. In addition to the terminal electrodes 20A and 20B, the dummy electrodes 20C and 20D conducted to neither the extracting conductor 19A nor the extracting conductor 19B are provided on the main surface 7*a* of the element body 7. The dummy electrodes 20C and 20D can be disposed at positons such that the balance of weight of the coil component 10 is stabilized. For this reason, it is possible to further stabilize the balance of weight of the coil component 10 in comparison with that in a case where only the terminal electrodes 20A and 20B are provided. As a result, it is possible to ensure greater ease of mounting when mounting the coil component 10 on a mounted component from the main surface 7*a* side. As described above, in the coil component 10, it is possible to prevent a decrease in inductance while ensuring greater ease of mounting.

In the coil component 10 of the embodiment, the electrodes (the terminal electrodes 20A and 20B and the dummy electrodes 20C and 20D) are respectively provided at all the corners R1 to R4 of the main surface 7*a* having a rectangular shape, and thus, it is possible to further stabilize the balance of weight of the coil component 10, and to improve the ease of mounting of the coil component 10.

Magnetic fluxes collide each other in the bent portions 12*a* to 12*d* of the coil 12, and as a result, the efficiency of the generation of magnetic fluxes is likely to decrease. In the coil component 10 of the embodiment, when viewed from the main surface 7*a* side, the electrodes (the terminal electrodes 20A and 20B and the dummy electrodes 20C and 20D) are respectively provided at the positions corresponding to the bent portions 12*a* to 12*d* in which the efficiency of the generation of magnetic fluxes is relatively low. As a result, the electrodes are unlikely to affect blocking of magnetic fluxes, and to affect a decrease in inductance.

In the power supply circuit unit 1 of the embodiment including the coil component 10, it is possible to prevent a decrease in inductance while ensuring the ease of mounting of the coil component 10. In the power supply circuit unit 1 including the coil component 10, it is possible to suitably prevent noise of the power supply IC mounted on the circuit substrate 2 of the power supply circuit unit 1. It is typically considered that if an inductance value is not suitable for the design of a power supply IC, noise occurs. In the power supply circuit unit 1, it is possible to prevent an unintended decrease in inductance, and as a result, it is possible to obtain a desired inductance value, and to suitably prevent noise. Noise is likely to occur at the periphery of a resonant frequency due to effects of high turbulence of inductance. At this time, it is considered that it is possible to prevent noise by moving the resonant frequency to a frequency higher than a frequency bandwidth in use, and reducing the effects of high turbulence of inductance.

Figure 13:
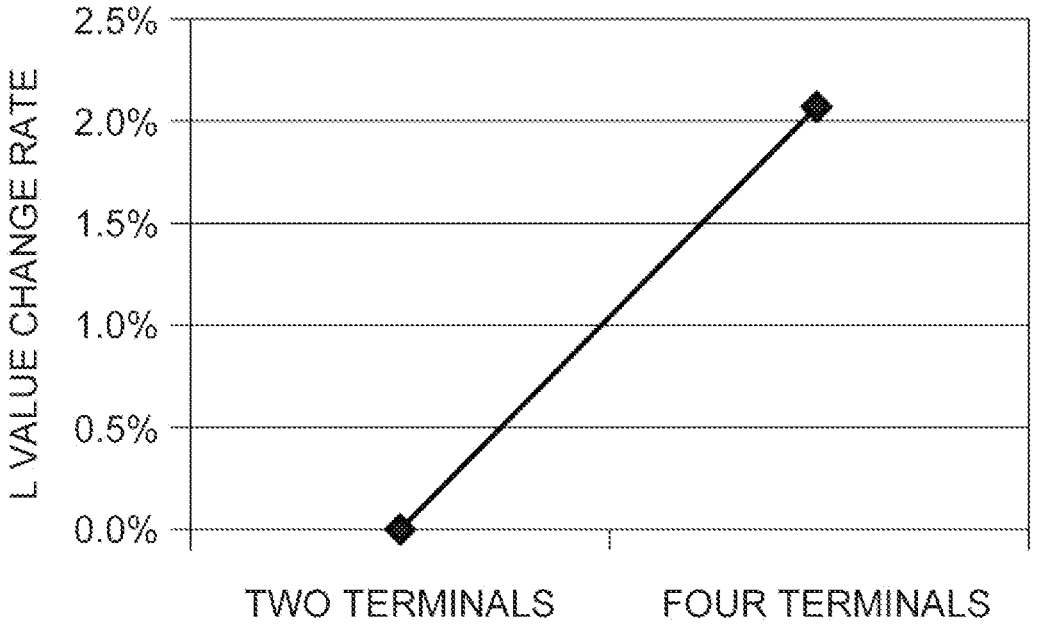
FIG. 13 is a graph illustrating a relationship between the number of terminals and an L value change rate.

Hereinafter, results of inventors' verifying that a decrease in inductance is actually prevented in the coil component 10 of the embodiment via tests will be described with reference to FIGS. 13 and 14. FIG. 13 is a graph illustrating a relationship between the number of terminals and an L value change rate. The horizontal axis of the graph of FIG. 13 represents the number of terminals, and the vertical axis of the graph of FIG. 13 represents the L value change rate. The "number of terminals" in the graph of FIG. 13 represents the number of electrodes positioned on the main surface 7*a* of the element body 7. The L value change rate in the graph of FIG. 13 represents the rate of an increase in inductance of a coil component with four terminals relative to that of a coil component with two terminals. The coil component illustrated in FIG. 13 in which the number of terminals is two represents the coil component 30 illustrated in FIG. 11. The coil component illustrated in FIG. 13 in which the number of terminals is four represents the coil component 10 of the embodiment. It is confirmed that as illustrated in the graph of FIG. 13, inductance of the coil component 10 with four terminals is higher than that of the coil component 30 with two terminals, and it is possible to prevent a decrease in inductance.

Figure 14:
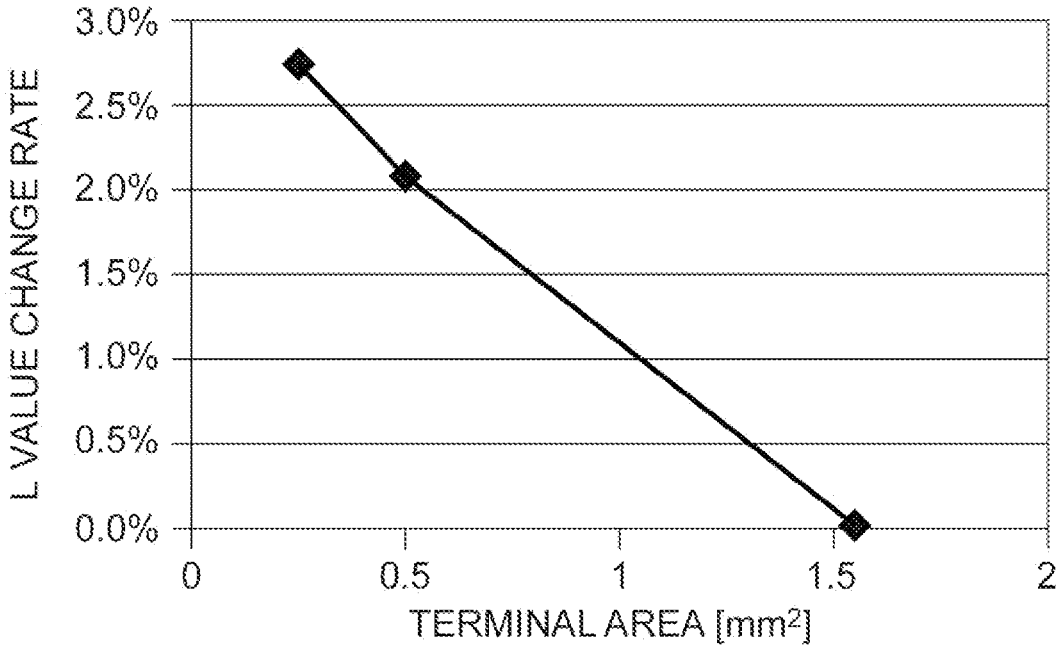
FIG. 14 is a graph illustrating a relationship between a terminal area and the L value change rate.

FIG. 14 is a graph illustrating a relationship between a terminal area and the L value change rate. The horizontal axis of the graph of FIG. 14 represents the terminal area, and the vertical axis of the graph of FIG. 14 represents the L value change rate. The L value change rate in the graph of FIG. 14 represents the rate of an increase in inductance with a decrease in terminal area. It is confirmed that as illustrated in FIG. 14, inductance increases to the extent that the terminal area is decreased. As a result, it is confirmed that it is possible to further prevent a decrease in inductance of the coil component 10 having a smaller terminal area than that of the coil component 30 having a large terminal area.

This disclosure is not limited to the first embodiment, and the aforementioned embodiment may be modified or may be applied in other manners insofar as the modification or application does not change the concept disclosed in the claims.

In the first embodiment, the terminal electrode 20A and the dummy electrode 20D are arranged on the same diagonal line, and the terminal electrode 20B and the dummy electrode 20C are arranged on the same diagonal line; however, this disclosure is not limited to that configuration. For example, a pair of the terminal electrodes 20A and 20B may be arranged on the same diagonal line, and a pair of the dummy electrodes 20C and 20D may be arranged on the same diagonal line. In other words, either the terminal electrode 20A or the terminal electrode 20B may be adjacent to either the dummy electrode 20C or the dummy electrode 20D along a long side of the main surface 7*a*.

The number of dummy electrodes may be one or three or more. For example, if one dummy electrode is to be provided, it is possible to ensure greater ease of mounting of a coil component by disposing the dummy electrode at a position (for example, a median position between the corners R3 and R4) that is spaced the same distance from the corner R1 and the corner R2, in addition to the terminal electrodes 20A and 20B which are respectively disposed at the corners R1 and R2.

The number of coil conductor layers and the like are not limited to those in the aforementioned embodiment. For example, the number of coil conductor layers of the coil 12 is not limited to two, and alternatively, may be one or three or more.

Second Embodiment

Figure 15:
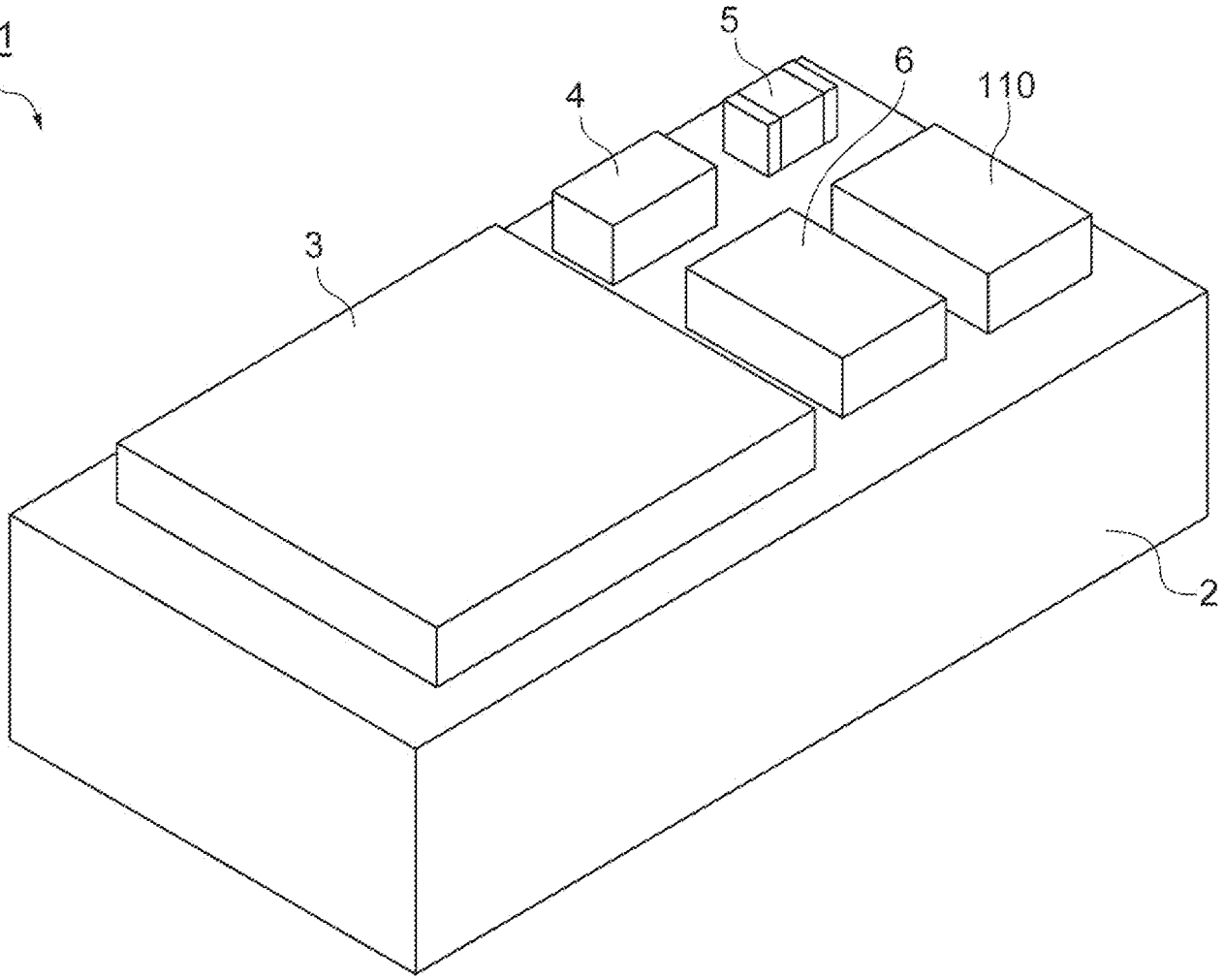
FIG. 15 is a perspective view illustrating a power supply circuit unit of a second embodiment of this disclosure.
Figure 16:
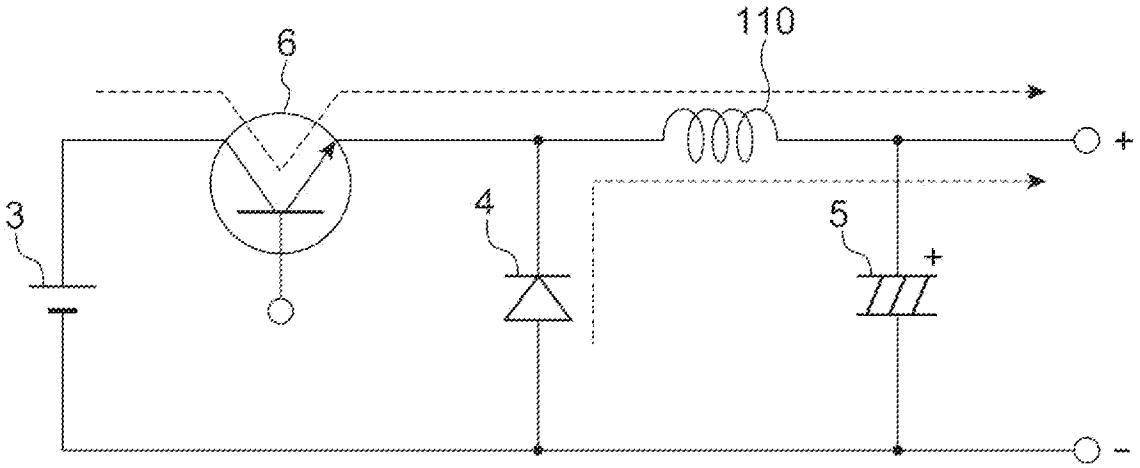
FIG. 16 is a circuit diagram illustrating an equivalent circuit of the power supply circuit unit illustrated in FIG. 15.

First, the entire configuration of a power supply circuit unit 101 of a second embodiment of this disclosure will be described with reference to FIGS. 15 and 16. The power supply circuit unit 101 to be described in the embodiment is a switching power supply circuit unit that converts (steps down) a direct voltage. As illustrated in FIGS. 15 and 16, the power supply circuit unit 101 includes the circuit substrate 2 and electronic components 3, 4, 5, 6 and 110. Specifically, the power supply circuit unit 101 is configured such that the power supply IC 3, the diode 4, the capacitor 5, the switching element 6, and a coil component 110 are mounted on the circuit substrate 2.

Figure 17:
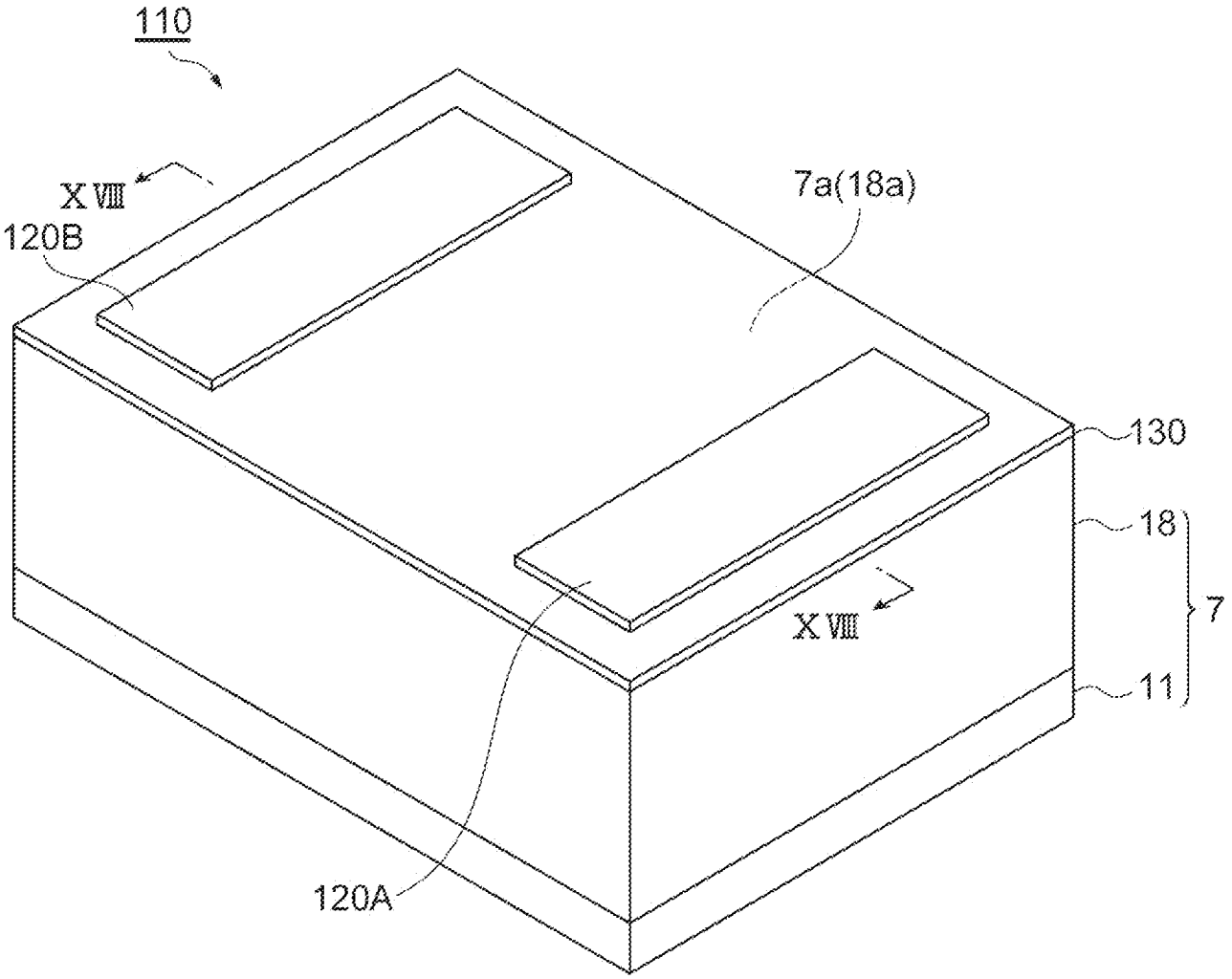
FIG. 17 is a perspective view of a coil component of the second embodiment.
Figure 18:
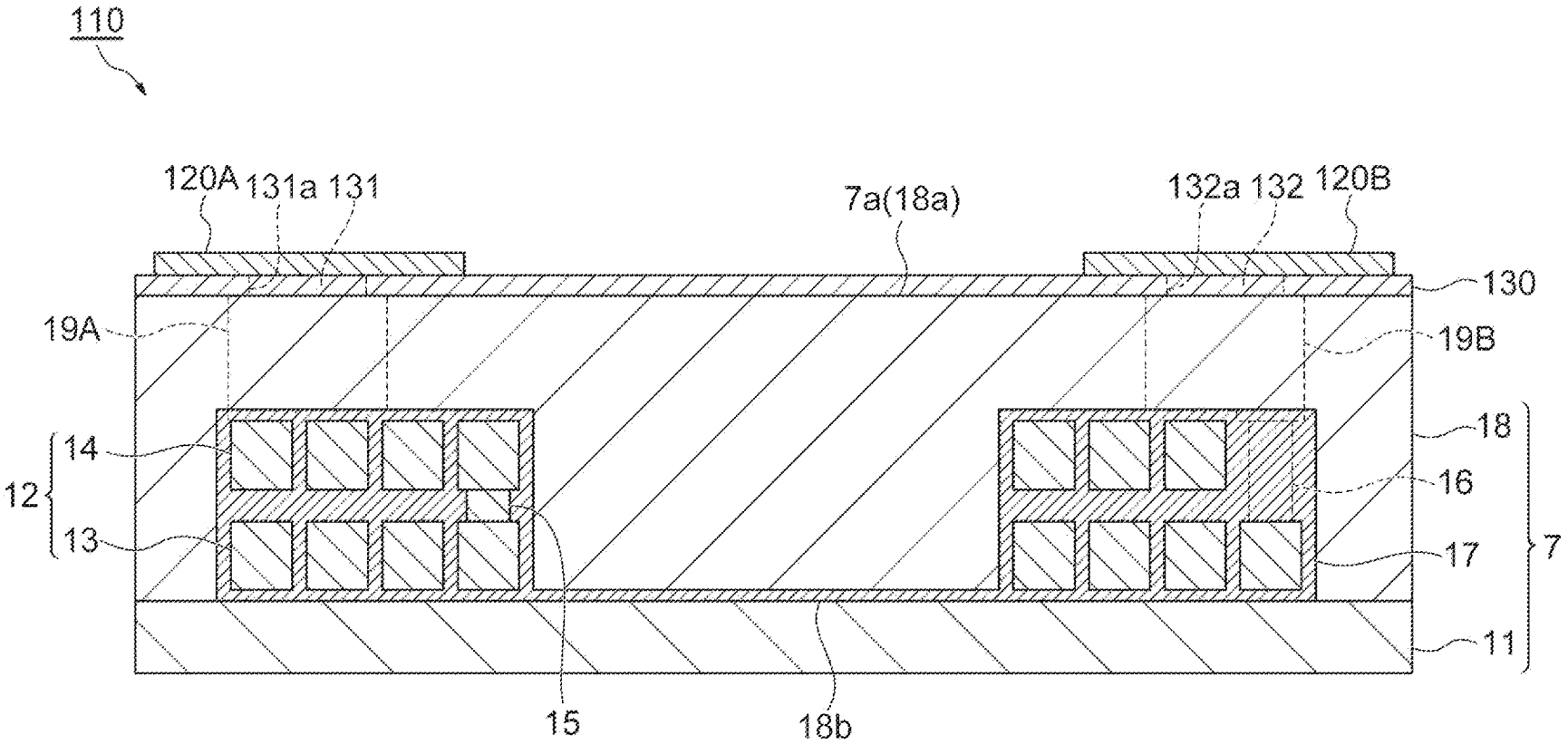
FIG. 18 is a sectional view of the coil component taken along line XVIII-XVIII in FIG. 17.
Figure 19:
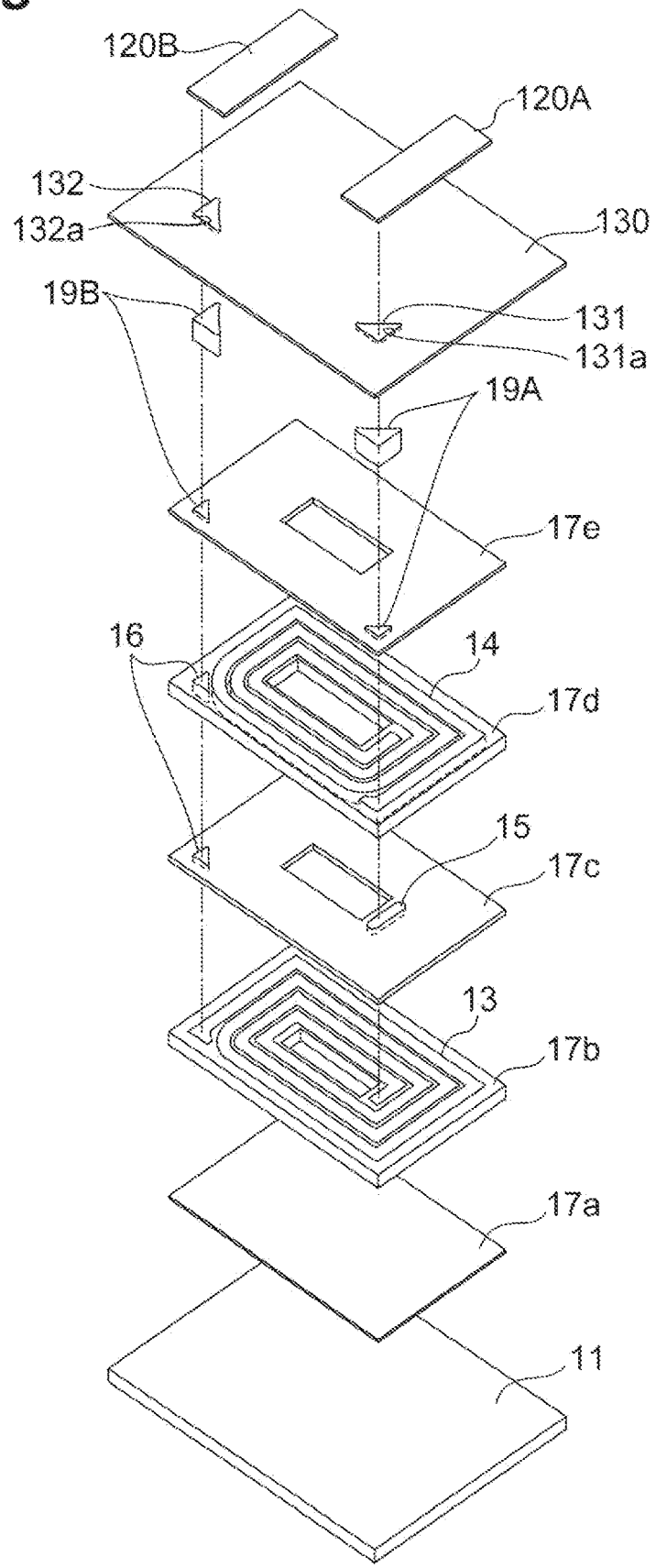
FIG. 19 is an exploded perspective view of the coil component.

The configuration of the coil component 110 of the second embodiment will be described with reference to FIGS. 17 to 19. FIG. 17 is a perspective view of the coil component 110 of the second embodiment. FIG. 18 is a sectional view of the coil component 110 taken along line XVIII-XVIII in FIG. 17. FIG. 19 is an exploded perspective view of the coil component. The exploded perspective view of FIG. 19 does not illustrate the magnetic resin layer 18 illustrated in FIG. 17.

As illustrated in FIG. 17, the coil component 110 includes the element body (magnetic element body) 7 inside of which the coil 12 (to be described later) is provided, and an insulating layer 130 provided on the main surface 7*a* of the element body 7. The element body 7 has a rectangular parallelepiped exterior. Examples of the rectangular parallelepiped shape include a rectangular parallelepiped shape having chamfered corners and ridge portions, and a rectangular parallelepiped shape having rounded corners and ridge portions. The element body 7 includes the main surface 7*a*. The main surface 7*a* has a rectangular shape having long sides and short sides. Examples of the rectangular shape include a rectangular shape having rounded corners.

Terminal electrodes 120A and 120B are provided on the main surface 7*a* with the insulating layer 130 interposed therebetween. The terminal electrode 120A is disposed along one short side of the main surface 7*a*, and the terminal electrode 120B is disposed along the other short side of the main surface 7*a*. The terminal electrodes 120A and 120B are spaced away from each other in the direction along the long sides of the main surface 7*a*.

For example, the element body 7 is formed of a magnetic material. Specifically, the element body 7 includes the magnetic substrate 11 and the magnetic resin layer 18.

The magnetic substrate 11 is a substantially flat substrate formed of a magnetic material such as ferrite (refer to FIG. 19). The magnetic substrate 11 is positioned on a side of the element body 7 which is opposite to the main surface 7*a*.

The magnetic resin layer 18 is formed on the magnetic substrate 11, and includes within the coil 12 (to be described later) (refer to FIGS. 18 and 19). The main surface 7*a* of the element body 7 is the surface 18*a* of the magnetic resin layer 18 which is opposite to the surface 18*b* that is a magnetic substrate 11 side surface of the magnetic resin layer 18. The magnetic resin layer 18 is a mixture of magnetic powder and binder resin. The material of the magnetic powder is iron, carbonyl iron, silicon, chromium, nickel, boron, or the like. The material of the binder resin is epoxy resin or the like. The magnetic resin layer 18 may be formed of 90% or more magnetic powder in its entirety.

Each of a pair of the terminal electrodes 120A and 120B which are provided on the main surface 7*a* of the element body 7 has the shape of a film, and has a substantially rectangular shape in a top view. The terminal electrodes 120A and 120B have substantially the same area. The terminal electrodes 120A and 120B are formed of a conductive material such as Cu. The terminal electrodes 120A and 120B are plating electrodes which are formed via plating. The terminal electrodes 120A and 120B may have a single-layer structure or a multi-layer structure.

As illustrated in FIGS. 18 to 19, the element body 7 of the coil component 110 includes the coil 12, the covering portion 17, and the extracting conductors 19A and 19B inside thereof (specifically, inside of the magnetic resin layer 18).

The coil 12 is wound into a rectangular shape in a top view. The coil 12 is formed of a metallic material such as Cu. The axial center of the coil 12 extends along the direction perpendicular to the main surface 7*a*. The coil 12 includes two coil conductor layers. The coil 12 includes the lower coil portion 13 and the upper coil portion 14 as the coil conductor layers, and the connection portions 15 and 16. The lower coil portion 13 and the upper coil portion 14 are arranged in the direction (axial direction of the coil 12) perpendicular to the main surface 7*a*. The upper coil portion 14 is positioned closer to the main surface 7*a* side than the lower coil portion 13. The lower coil portion 13 and the upper coil portion 14 have the same winding direction. The connection portion 15 is interposed between the lower coil portion 13 and the upper coil portion 14. An innermost winding portion of the lower coil portion 13 is connected to an innermost winding portion of the upper coil portion 14 via the connection portion 15. The connection portion 16 extends from the lower coil portion 13 toward the main surface 7*a* side. The lower coil portion 13 is connected to the extracting conductor 19B via the connection portion 16.

The covering portion 17 has insulative properties, and is formed of insulative resin. Examples of the insulative resin used in the covering portion 17 include polyimide and polyethylene terephthalate. The covering portion 17 integrally covers the lower coil portion 13 and the upper coil portion 14 of the coil 12 inside of the element body 7. The covering portion 17 individually covers the lower coil portion 13, the upper coil portion 14, and the connection portion 15. The covering portion 17 has a layered structure, and includes the five insulative resin layers 17*a*, 17*b*, 17*c*, 17*d*, and 17*e* in the embodiment (refer to FIG. 19). The insulative resin layer 17*a* is positioned on the lower side (magnetic substrate 11 side) of the lower coil portion 13. In a top view, the insulative resin layer 17*a* is formed in substantially the same as a region in which the coil 12 is formed. The periphery of and gaps between winding portions of the lower coil portion 13 are filled with the insulative resin layer 17*b* which is the same as the layer of the lower coil portion 13. The insulative resin layer 17*b* has an open region that corresponds to the inner diameter of the coil 12. The insulative resin layer 17*b* extends along a direction perpendicular to the magnetic substrate 11. The insulative resin layer 17*c* is interposed between the lower coil portion 13 and the upper coil portion 14, and has an open region that corresponds to the inner diameter of the coil 12. The periphery of and gaps between winding portions of the upper coil portion 14 are filled with the insulative resin layer 17*d* which is the same as the layer of the upper coil portion 14. The insulative resin layer 17*d* has an open region that corresponds to the inner diameter of the coil 12. The insulative resin layer 17*e* is positioned on the upper side (main surface 7*a* side) of the upper coil portion 14, and has an open region that corresponds to the inner diameter of the coil 12.

A pair of the extracting conductors 19A and 19B are formed of Cu, and extend from both end portions E1 and E2 of the coil 12 along the direction perpendicular to the main surface 7*a*.

The extracting conductor 19A is connected to one end portion E1 of the coil 12, which is provided in an outermost winding portion of the upper coil portion 14. The extracting conductor 19A extends from the end portion E1 of the coil 12 to the main surface 7*a* of the element body 7 while passing through the magnetic resin layer 18. The extracting conductor 19A is exposed to the main surface 7*a*. The terminal electrode 120A is provided at a position corresponding to an exposed portion of the extracting conductor 19A. The extracting conductor 19A is connected to the terminal electrode 120A via a conductor portion 131 in a through hole 131*a* of the insulating layer 130. Accordingly, the end portion E1 of the coil 12 is electrically connected to the terminal electrode 120A via the extracting conductor 19A and the conductor portion 131.

The extracting conductor 19B is connected to the other end portion E2 of the coil 12, which is provided in an outermost winding portion of the lower coil portion 13. The extracting conductor 19B extends from the end portion E2 of the coil 12 to the main surface 7*a* of the element body 7 while passing through the magnetic resin layer 18. The extracting conductor 19B is exposed to the main surface 7*a*. The terminal electrode 120B is provided at a position corresponding to an exposed portion of the extracting conductor 19B. The extracting conductor 19B is connected to the terminal electrode 120B via a conductor portion 132 in a through hole 132*a* of the insulating layer 130. Accordingly, the end portion E2 of the coil 12 is electrically connected to the terminal electrode 120B via the extracting conductor 19B and the conductor portion 132.

The insulating layer 130 provided on the main surface 7*a* of the element body 7 is interposed between the pair of the terminal electrodes 120A and 120B on the main surface 7*a*. In the embodiment, the insulating layer 130 is provided such that the entire region of the main surface 7*a* is covered with the insulating layer 130, and the pair of extracting conductors 19A and 19B are exposed. The insulating layer 130 includes a portion that extends across the main surface 7*a* in a direction intersecting a longitudinal direction (alignment direction of the pair of terminal electrodes 120A and 120B) of the main surface 7*a*. The insulating layer 130 includes the through holes (holes) 131*a* and 132*a* at positions corresponding to the extracting conductors 19A and 19B. The conductor portions 131 and 132 formed of a conductive material such as Cu are respectively provided in the through holes 131*a* and 132*a*. The insulating layer 130 is formed of an insulative material, and is formed of insulative resin such as polyimide or epoxy.

Hereinafter, a method of making the coil component 110 will be described. FIGS. 20A to 20D are views illustrating steps of making the coil component 110.

Figure 20A:
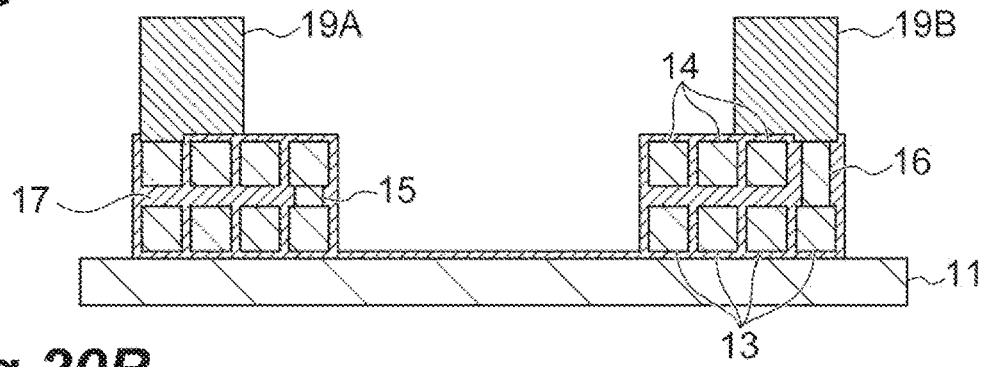
FIGS. 20A to 20D are views illustrating steps of making the coil component.

Similar to the method of making the coil component 10 of the first embodiment, in a method of making the coil component 110 of the second embodiment, steps including the step of removing the plating layer 24 not covered with the covering portion 17 are performed (refer to FIGS. 8A to 9D). As illustrated in FIG. 20A, the extracting conductor 19A is formed at a position corresponding to the opening portion 19A' of the insulative resin layer 17*e*, and the extracting conductor 19B is formed at a position corresponding to the opening portion 19B'. Specifically, seed portions for the extracting conductors 19A and 19B are formed on the opening portions 19A' and 19B' using a predetermined mask via plating or sputtering, and the extracting conductors 19A and 19B are formed using the seed portions via plating.

Figure 20B:
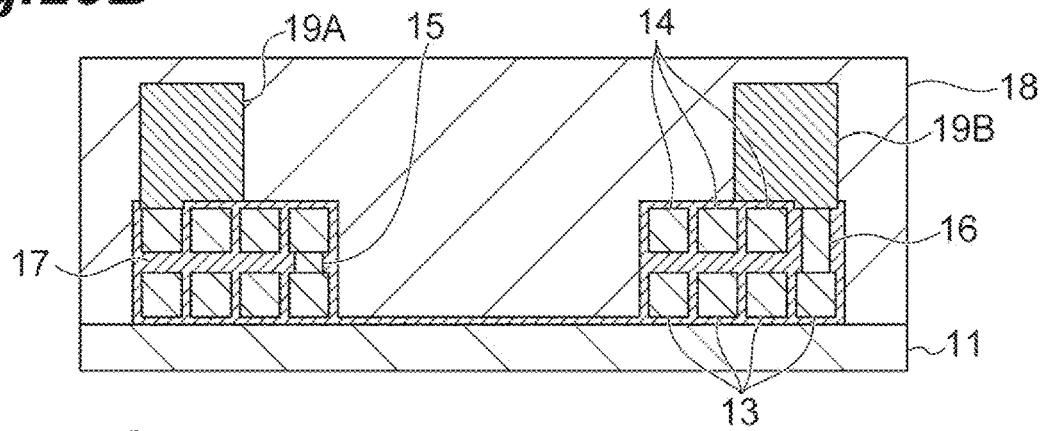
Figure 20C:
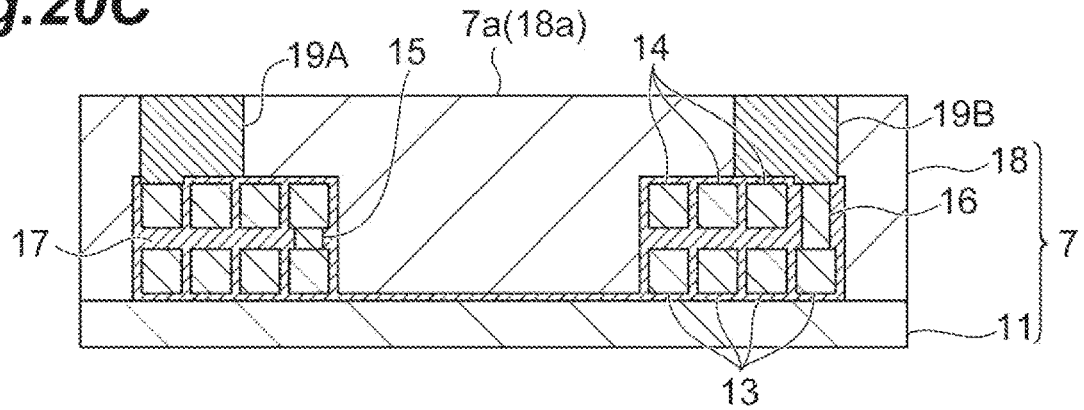

Subsequently, as illustrated in FIG. 20B, the magnetic resin layer 18 is formed by coating the entire surface of the magnetic substrate 11 with magnetic resin and hardening the magnetic resin by a predetermined method. As a result, the peripheries of the covering portion 17 and the extracting conductors 19A and 19B are covered with the magnetic resin layer 18. At this time, an inner-diameter portion of the coil 12 is filled with the magnetic resin layer 18. Subsequently, as illustrated in FIG. 20C, grinding is performed such that the extracting conductors 19A and 19B are exposed from the magnetic resin layer 18.

The element body 7 in which the extracting conductors 19A and 19B are exposed from the main surface 7*a* of the element body 7 is obtained by the aforementioned steps. A step of preparing the element body 7 is complete.

Figure 20D:
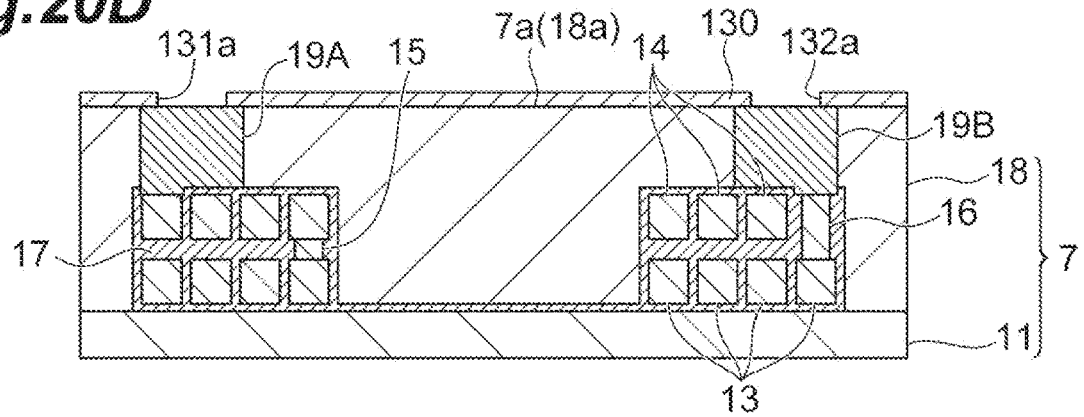

Subsequently, as illustrated in FIG. 20D, the insulating layer 130 is formed by coating the main surface 7*a* with an insulative material such as an insulative resin paste before forming the terminal electrodes 120A and 120B via plating. The insulating layer 130 is formed such that the entirety of the main surface 7*a* is covered with the insulating layer 130, the through holes 131*a* and 132*a* are formed in the insulating layer 130 at the positions corresponding to the pair of extracting conductors 19A and 19B, and the pair of extracting conductors 19A and 19B are exposed from the insulating layer 130. Specifically, the entire region of the main surface 7*a* is coated with an insulative material, and thereafter, portions of the insulating layer 130 at locations corresponding to the extracting conductors 19A and 19B are removed.

Seed portions (not illustrated) are formed in regions on the insulating layer 130, which correspond to the terminal electrodes 120A and 120B, using a predetermined mask via plating or sputtering. Seed portions are also formed on the extracting conductors 19A and 19B which are exposed from the through holes 131*a* and 132*a* of the insulating layer 130. Subsequently, the terminal electrodes 120A and 120B are formed using the seed portions via electroless plating. At this time, plating develops layers with which the through holes 131*a* and 132*a* of the insulating layer 130 are filled. The developed plating layers form the conductor portions 131 and 132, and form the terminal electrodes 120A and 120B on the insulating layer 130. As a result, the coil component 110 is formed.

In the method of making the coil component 110 of the embodiment, after the insulating layer 130 is formed in at least a portion of the main surface 7*a* of the element body 7 between the pair of terminal electrodes 120A and 120B, and the pair of terminal electrodes 120A and 120B are formed via plating. Plating is not formed in the portion in which the insulating layer 130 is formed when the pair of terminal electrodes 120A and 120B are formed via plating, that is, in at least the portion between the pair of terminal electrodes 120A and 120B. Accordingly, it is possible to prevent an event that unnecessary plating is formed when forming the terminal electrodes 120A and 120B. As a result, it is possible to prevent an event that plating is formed between the pair of terminal electrodes 120A and 120B to connect together the terminal electrodes 120A and 120B. It is possible to reduce a possibility that the terminal electrodes 120A and 120B may be conducted to each other and a short circuit therebetween may occur due to such plating.

Since the insulating layer 130 includes the portion that extends across the main surface 7*a* in the direction intersecting the alignment direction of the pair of terminal electrodes 120A and 120B, it is possible to prevent an event that unnecessary plating is formed. A short circuit route between the pair of terminal electrodes 120A and 120B on the main surface 7*a* is completely blocked by the insulating layer 130. Accordingly, it is possible to more reliably reduce a possibility that the pair of terminal electrodes 120A and 120B may be conducted to each other and a short circuit therebetween may occur by the formation of the terminal electrodes 120A and 120B via plating.

The insulating layer covers portions apart from the through holes 131*a* and 132*a* required for conduction between the terminal electrodes 120A and 120B, and it is possible to further prevent an event that unnecessary plating is formed. Since the pair of terminal electrodes 120A and 120B are more reliably insulated from each other by the insulating layer 130, it is possible to more reliably reduce a possibility that the pair of terminal electrodes 120A and 120B may be conducted to each other and a short circuit therebetween may occur by the formation of the terminal electrodes 120A and 120B via plating.

In the method of making the coil component 110 of the embodiment, the insulating layer 130 may be formed of insulative resin.

In the coil component 110, the insulating layer 130 is formed in at least a portion of the main surface 7*a* of the element body 7 between the pair of terminal electrodes 120A and 120B which are plating electrodes. Accordingly, plating is not formed in the portion in which the insulating layer 130 is formed, that is, in at least the portion between the pair of terminal electrodes 120A and 120B. As a result, it is possible to prevent an event that unnecessary plating is formed via plating. It is possible to prevent an event that plating is formed between the pair of terminal electrodes 120A and 120B to connect together the terminal electrodes 120A and 120B. It is possible to reduce a possibility that the terminal electrodes 120A and 120B may be conducted to each other and a short circuit therebetween may occur due to such plating.

Since the power supply circuit unit 101 includes the coil component 110 in which it is possible to reduce a possibility that the terminal electrodes 120A and 120B may be conducted to each other and a short circuit therebetween may occur due to unnecessary plating, it is possible to reduce a possibility of the occurrence of a short circuit of the power supply circuit unit 101 in its entirety.

This disclosure is not limited to the second embodiment, and the second embodiment may be modified or may be applied in other manners insofar as the modification or application does not change the concept disclosed in the claims.

In the second embodiment, the insulating layer 130 is provided in such a way as to cover the entirety of the main surface 7*a* of the element body 7; however, this disclosure is not limited to that configuration. The insulating layer 130 may be provided in at least a portion of the main surface 7*a* between the pair of terminal electrodes 120A and 120B. For example, the insulating layer 130 may have a shape in which the insulating layer 130 extend across the main surface 7*a* in the direction intersecting the longitudinal direction (alignment direction of the pair of terminal electrodes 120A and 120B) of the main surface 7*a*.

In the aforementioned embodiment, the terminal electrodes 120A and 120B are provided on the insulating layer 130; however, this disclosure is not limited to that configuration. For example, the insulating layer 130 may be provided with through holes having dimensions and shapes corresponding to regions in which the terminal electrodes 120A and 120B are formed. The terminal electrodes 120A and 120B may be in direct contact with the main surface 7*a* of the element body 7.

In the aforementioned embodiment, the terminal electrodes 120A and 120B and the conductor portions 131 and 132 are formed at once. Alternatively, the terminal electrodes 120A and 120B and the conductor portions 131 and 132 may be formed separately. In this case, the material of the terminal electrodes 120A and 120B may be different from that of the conductor portions 131 and 132.

The number of coil conductor layers is not limited to that in the aforementioned embodiment. For example, the number of coil conductor layers of the coil 12 is not limited to two, and may be one or three or more.

What is claimed is:

1. A coil component comprising:

a magnetic element body having (i) exterior faces wherein one of the exterior faces is a main upper surface, (ii) a coil (a) having two end portions, (b) spaced below the main upper surface, (c) having a center axis that is perpendicular to the main upper surface, and (d) including two coil conductor layers having winding portions that overlap in the direction of the center axis and (iii) a pair of extracting conductors (a) extending from both end portions of the coil to the main upper surface perpendicular to the main upper surface and (b) being exposed to the exterior faces of the magnetic element body only at the main upper surface; an insulating layer on only the main upper surface of the magnetic element body and not on any other of the exterior faces; and a pair of terminal electrodes (i) above the main upper surface of the magnetic element body, and (ii) being plating electrodes electrically connected to the pair of extracting conductors exposed to the main upper surface, wherein the coil is the only coil in the magnetic element body; the pair of extracting conductors are the only extracting conductors in the magnetic element body; a first of the two end portions is at a first end of the winding portion of a first of the two coil conductor layers; a second of the two end portions is at a second end of the winding portion of a second of the two coil conductor layers; the two coil conductor layers are directly electrically connected; the insulating layer is between the pair of terminal electrodes; and the pair of terminal electrodes covers only a part of the main upper surface and none of the any other exterior faces of the magnetic element body.

2. A power supply circuit unit comprising:

the coil component according to claim 1.

* * * * *